US007318401B2

(12) United States Patent
Pluta et al.

(10) Patent No.: US 7,318,401 B2
(45) Date of Patent: Jan. 15, 2008

(54) VARIABLE CHAMBER VOLUME PHASER

(75) Inventors: Christopher J. Pluta, Ithaca, NY (US); Roger P. Butterfield, Trumansburg, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/375,725

(22) Filed: Mar. 15, 2006

(65) Prior Publication Data

US 2007/0215084 A1 Sep. 20, 2007

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | | |
|---|---|---|---|---|
| 4,809,650 | A | 3/1989 | Arai et al. | 123/78 B |
| 4,934,347 | A | 6/1990 | Suga et al. | 123/78 B |
| 5,002,023 | A | 3/1991 | Butterfield et al. | 123/90.15 |
| 5,107,804 | A | 4/1992 | Becker et al. | 123/90.17 |
| 5,172,659 | A | 12/1992 | Butterfield et al. | 123/90.17 |
| 5,361,735 | A | 11/1994 | Butterfield et al. | 123/90.17 |
| 5,497,738 | A | 3/1996 | Siemon et al. | 123/90.17 |
| 5,657,725 | A | 8/1997 | Butterfield et al. | 123/90.17 |
| 5,823,152 | A | 10/1998 | Ushida | 123/90.17 |
| 6,155,221 | A | 12/2000 | Ushida | 123/90.17 |
| 6,199,524 | B1 | 3/2001 | Ushida | 123/90.17 |
| 6,250,265 | B1 | 6/2001 | Simpson | 123/90.17 |
| 6,263,846 | B1 | 7/2001 | Simpson et al. | 123/90.17 |
| 6,389,809 | B1 | 5/2002 | Niidome et al. | 60/443 |
| 6,453,859 | B1 | 9/2002 | Smith et al. | 123/90.17 |
| 6,532,921 | B2 | 3/2003 | Sato et al. | 123/90.17 |
| 6,763,791 | B2 | 7/2004 | Gardner et al. | 123/90.17 |
| 6,883,481 | B2 | 4/2005 | Gardner et al. | 123/90.17 |
| 6,941,912 | B2 | 9/2005 | Palesch et al. | 123/90.17 |
| 6,997,150 | B2 | 2/2006 | Simpson | 123/90.17 |

*Primary Examiner*—Zelalem Eshete
(74) *Attorney, Agent, or Firm*—Brown & Michaels, PC

(57) ABSTRACT

A variable cam timing phaser including a housing, a rotor coaxially located within the housing, a phase control valve, a switching valve, and a passage connecting the first advance and retard chambers. The housing and the rotor define at least two chambers, a first chamber separated by a first vane into the first advance and retard chambers, and a second chamber separated by a second vane into the second advance and retard chambers. The switching valve has a first position in which fluid may flow freely between the passage connecting the first advance and retard chambers and fluid flow from the phase control valve to the first advance and first retard chambers is blocked. In the second position, the passage connecting the first advance and retard chambers is blocked and fluid may flow freely between the phase control valve and the first advance and first retard chambers.

45 Claims, 24 Drawing Sheets

VARIABLE CHAMBER VOLUME PHASER

BACKGROUND OF THE INVENTION

1. Field of the Invention

The invention pertains to the field of variable cam timing system. More particularly, the invention pertains to a variable cam timing system with variable chamber volume.

2. Description of Related Art

Cam torque actuated (CTA) phasers use torque reversals in the camshaft, caused by the forces of opening and closing engine valves to move the vane. Control valves are present to allow fluid flow from chamber to chamber causing the vane to move, or to stop the flow of oil, locking the vane in position. The CTA phaser has oil input to make up for losses due to leakage, but does not use engine oil pressure to move the phaser. CTA phasers have shown that they provide fast response and low oil usage, reducing fuel consumption and emissions. However, in some engines, i.e. 4-cylinder engines, the torsional energy from the camshaft is not sufficient to actuate the phaser over the entire speed range of the engine, especially when the rpm is high and optimization of the performance of the phaser in view of engine operating conditions (e.g. the amount of available cam torque) is necessary.

FIGS. 1*a* through 1*c* show a conventional cam torque actuated phaser (CTA). Torque reversals in the camshaft caused by the forces of opening and closing engine valves move the vane 106. The advance and retard chambers are arranged to resist positive and negative torque pulses in the camshaft and are alternatively pressurized by the cam torque. The control valve 104 in a CTA system allows the vane 106 in the phaser to move, by permitting fluid flow from the advance chamber 108 to the retard chamber 110 or vice versa, depending on the desired direction of movement, as shown in FIGS. 1*a* and 1*b*. Positive cam torsionals are used to retard the phaser, as shown in FIG. 1*a*. Negative cam torsionals are used to advance the phaser, as shown in FIG. 1*b*. A null or central position, as shown in FIG. 1*c*, stops the flow of fluid, locking the vane in position.

More specifically, in moving towards the retard position of the phaser, as shown in FIG. 1*a*, the spool valve 104 is internally mounted within the rotor and includes a sleeve 117 for receiving a spool 109 with lands 109*a*, 109*b*, 109*c* and a biasing spring 105. A variable force solenoid (VFS) 103, which is controlled by an ECU 102, moves the spool 109 within the sleeve 117. In moving towards the retard position, as shown in FIG. 1*a*, the force of the VFS 103 was reduced and the spool 109 was moved to the left by spring 105, until the force of the spring 105 balanced the force of the VFS 103. In the position shown, spool land 109*b* blocks line 113, and lines 112 and 116 are open. Camshaft torque pressurizes the advance chamber 108, causing fluid in the advance chamber 108 to move into the retard chamber 110. Fluid exiting the advance chamber 108 moves through line 112 and the fluid moves and into the spool valve 104 between spool lands 109*a* and 109*b*. From the spool valve 104, fluid move back into line 116 where it feeds into line 113 supplying fluid to the retard chamber 110. As stated earlier positive cam torsionals are used to aid in moving the vane 106.

Makeup oil is supplied to the phaser from supply S to make up for leakage and enters line 118 and moves through inlet check valve 119 to the spool valve 104. From the spool valve fluid enters line 116 through either of the check valves 114, 115, depending on which is open to either the advance chamber 108 or the retard chamber 110.

To move towards the advance position of the phaser, as shown in FIG. 1*b*, the force of the VFS 103 was increased and the spool was moved to the right by the VFS 103, until the force of the spring balances the force of the VFS 103. In the position shown, spool land 109*a* blocks the exit of fluid from line 112, and lines 113 and 116 are open. Camshaft torque pressurizes the retard chamber 110, causing fluid in the retard chamber 110 to move into the advance chamber 108. Fluid exiting the retard chamber 110 moves through line 113 and into the spool valve 104 between lands 109*a* and 109*b*. From the spool valve 104, the fluid enters line 116 and travels through open check valve 114 into line 112 and the advance chamber 108. As stated earlier only negative cam torsionals are used to move the vane 106.

Makeup oil is supplied to the phaser from supply to make up for leakage and enters line 118 and moves through inlet check valve 119 to the spool valve 104. From the spool valve fluid enters line 116 through either of the check valves 114, 115, depending on which is open to either the advance chamber 108 or the retard chamber 110.

FIG. 1*c* shows the phaser in null or a central position where the spool lands 109*a*, 109*b* block lines 112 and 113, respectively and vane 106 is locked into position. A small amount of fluid is provided to the phaser to make up for losses due to leakage.

U.S. Pat. No. 4,809,650 discloses a variable volume chamber in which the surface area of the chambers does not change, but the volume of fluid present does. Hydraulic fluid is fed into a variable volume chamber defined between an outer piston and an inner piston which is reciprocatively disposed therein, via a supply passage which includes a one-way valve. A valve chamber is present between the two chambers and contains a spool valve. When low compression engine operation is required, the pressure is supplied to the valve chamber, moving the spool valve so that the supply passage is closed. Transfer passages and a drain passage are open. The drain passage leads directly to the cylinder bore so that hydraulic fluid in the variable volume chamber is vented in an unrestricted manner. U.S. Pat. No. 4,934,347 is similar and discloses a damping device that is a small diameter piston-like valve element in a coaxial bore in the large land of the spool.

U.S. Pat. No. 5,823,152 discloses a rotor and a housing that define chambers whose volumes are variable in accordance with rotational position of the rotor with respect to the housing, but the surface area remains the same. The vanes have drain holes. A stopper piston serves as a locking member and is housed in the vane. A switching valve directs fluid to the chambers. Other examples of a rotor and a housing that define chambers whose volumes are variable in accordance with rotational position of the rotor with respect to the housing, but the surface area remains the same, include U.S. Pat. No. 6,155,221 and U.S. Pat. No. 6,199,524.

U.S. Pat. No. 6,389,809 discloses a volume control valve for controlling the volume of a variable displacement type hydraulic rotary machine. The volume control valve includes a housing with a bore for receiving a spool that selectively blocks communication of a pressure oil feed/discharge port with a high pressure port and a tank port. A first pressure receiving portion is formed in the spool to receive a load pressure as a pilot pressure is introduced for displacing the spool axially within the bore. The volume control valve is selectively controlled using an external command pressure. When the external command pressure is down to the tank pressure, the spool maintains the position regardless of the pilot pressure introduced from the pilot port and the volume control valve is fixed at a large volume.

When the external command pressure is increased to displace the spool in the opposite direction, the spool slides in the direction in accordance with the pilot pressure of the hydraulic rotary machine. In this state, the spool receives an external command pressure in the opposite direction and the volume control can make a selective volume control by utilizing the difference between the external command pressure and the pilot pressure. Again, the surface area of the variable displacement type hydraulic rotary machine does not change.

Therefore, there is need for a phaser that optimizes the phaser with respect to engine conditions and varies the surface area of the chambers to ensure that the chambers have a suitable surface area as required by the engine for optimum performance.

SUMMARY OF THE INVENTION

A variable cam timing phaser including a housing, a rotor coaxially located within the housing, a phase control valve, a switching valve, and a passage connecting the first advance and retard chambers. The housing and the rotor define at least two chambers, a first chamber separated by a first vane into the first advance and retard chambers, and a second chamber separated by a second vane into the second advance and retard chambers. The switching valve has a first position in which fluid may flow freely between the passage connecting the first advance and retard chambers and fluid flow from the phase control valve to the first advance and first retard chambers is blocked. In the second position, the passage connecting the first advance and retard chambers is blocked and fluid may flow freely between the phase control valve and the first advance and first retard chambers.

In another embodiment, the phaser has a third chamber defined by the housing and the rotor and separated by a third vane into a third advance chamber and a third retard chamber. When the switching valve is in the first position, the first advance chamber, the first retard chamber, the third advance chamber, and the third retard chamber are switched out of use, by allowing fluid flow between the first advance chamber and the first retard chamber, the first advance chamber and the third advance chamber, the first retard chamber and the third retard chamber, and fluid is blocked from entering the first advance chamber, the first retard chamber, the third advance chamber, and the third retard chamber.

The phase control valve is preferably a spool valve including a spool having a plurality of lands slidably received in a bore of the rotor.

The switching valve is preferably a spool valve including a spool having a plurality of lands slidably received in a bore of the rotor. The switching valve may be actuated by a variable force solenoid, a centrifugal valve, an on/off valve, a pump, oil pressure, electromechanically, or other similar device.

The first vane and the third vane may be connected in parallel.

The passages connecting the first advance chamber to the first retard chamber, the first advance chamber to the third advance chamber, and the first retard chamber to the third retard chamber allow for fluid flow between the chambers without any intervening valves or structures that prevent bidirectional fluid flow.

DETAILED DESCRIPTION OF THE INVENTION

Internal combustion engines have employed various mechanisms to vary the angle between the camshaft and the crankshaft for improved engine performance or reduced emissions. The majority of these variable camshaft timing (VCT) mechanism use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the housing, and the chambers in the rotor, as well. The housing's outer circumference forms the sprocket, pulley or gear accepting drive force through a chain, belt, or gears, usually from the crankshaft, or possible from another camshaft in a multiple-cam engine.

Figure 1A:
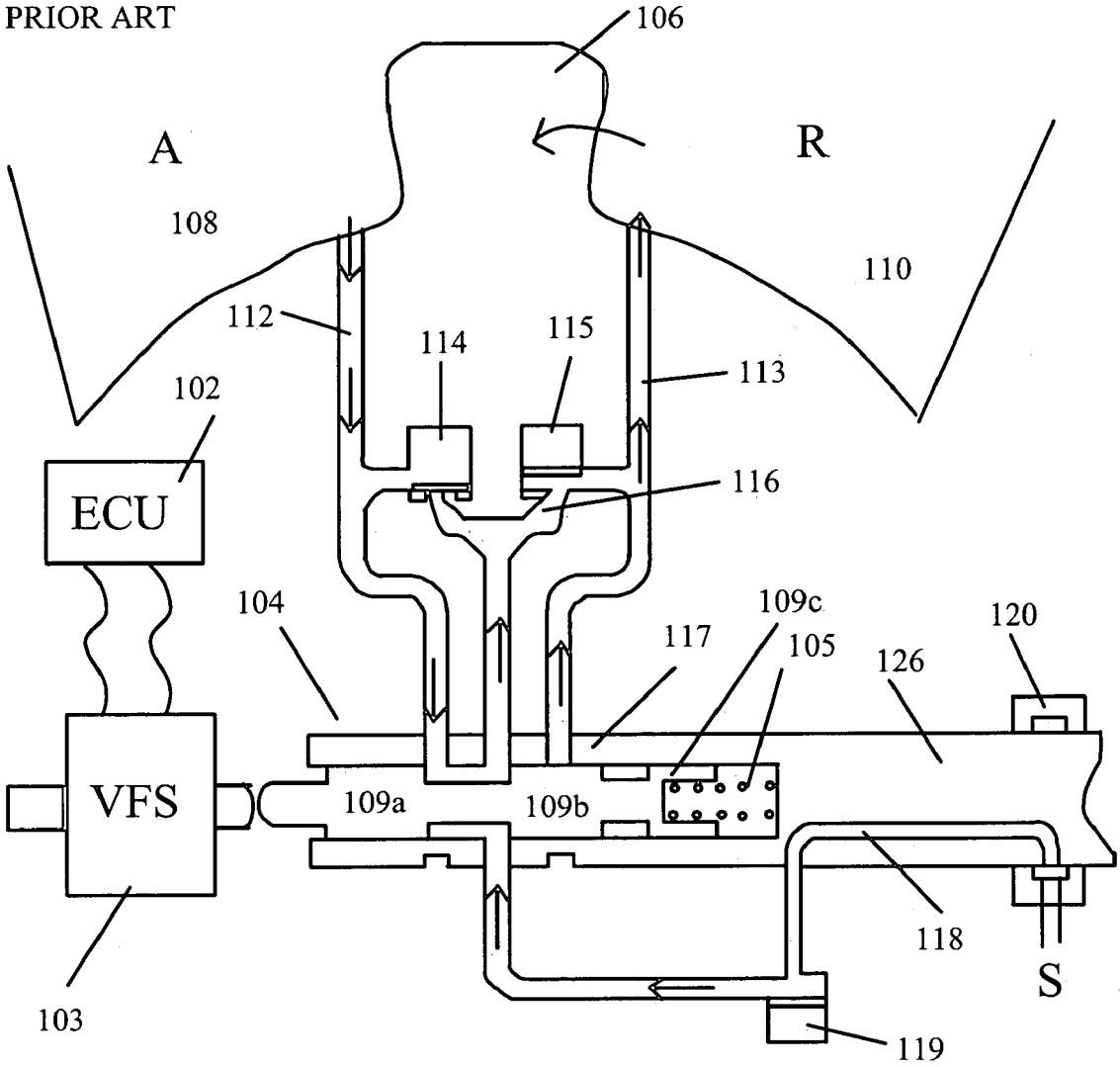
Fig. 1a PRIOR ART
FIG. 1*a* shows a schematic of a conventional cam torque actuated (CTA) phaser shifting to a retard position.
Figure 1B:
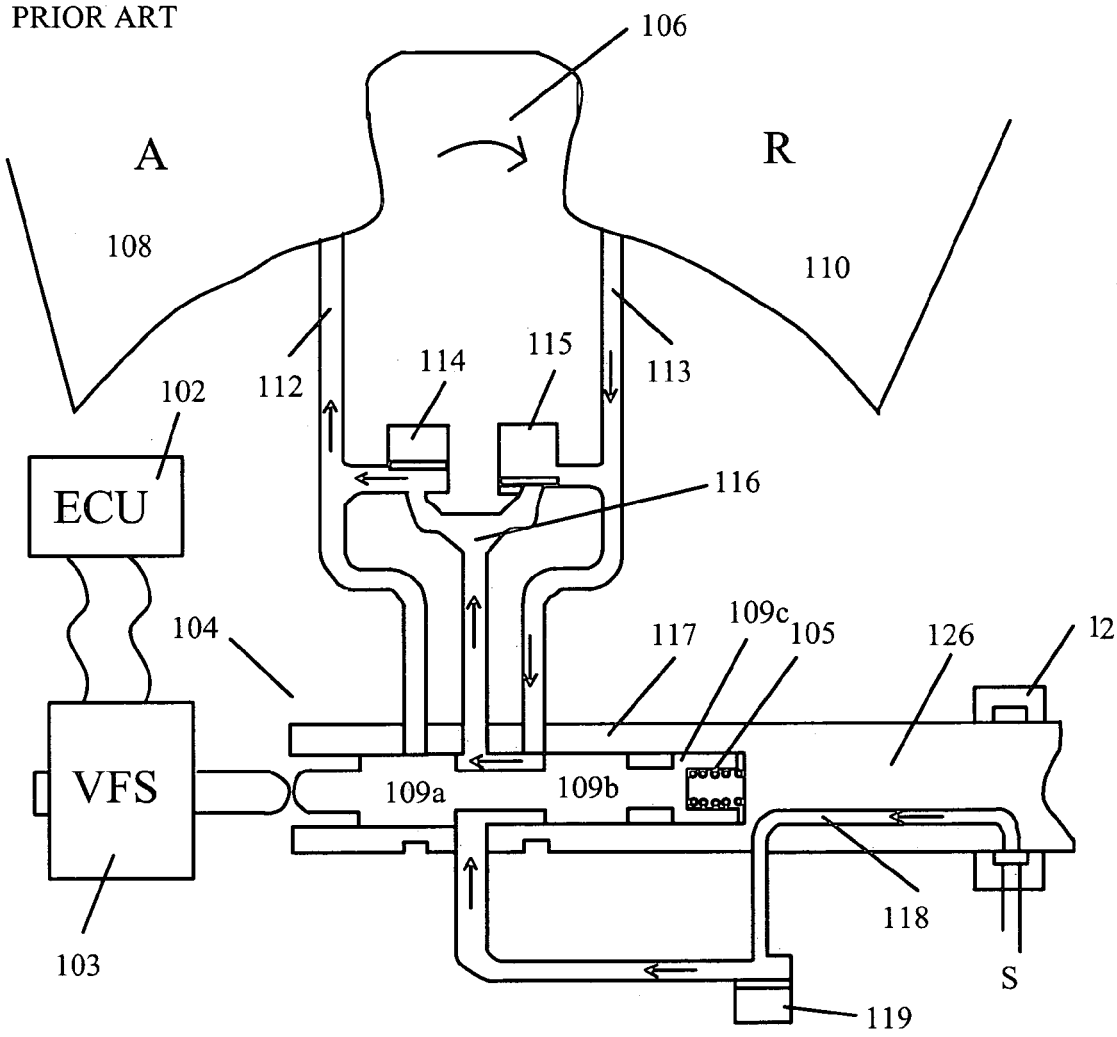
Fig. 1b PRIOR ART
FIG. 1*b* shows a schematic of a conventional cam torque actuated (CTA) phaser shifting to an advance position.
Figure 1C:
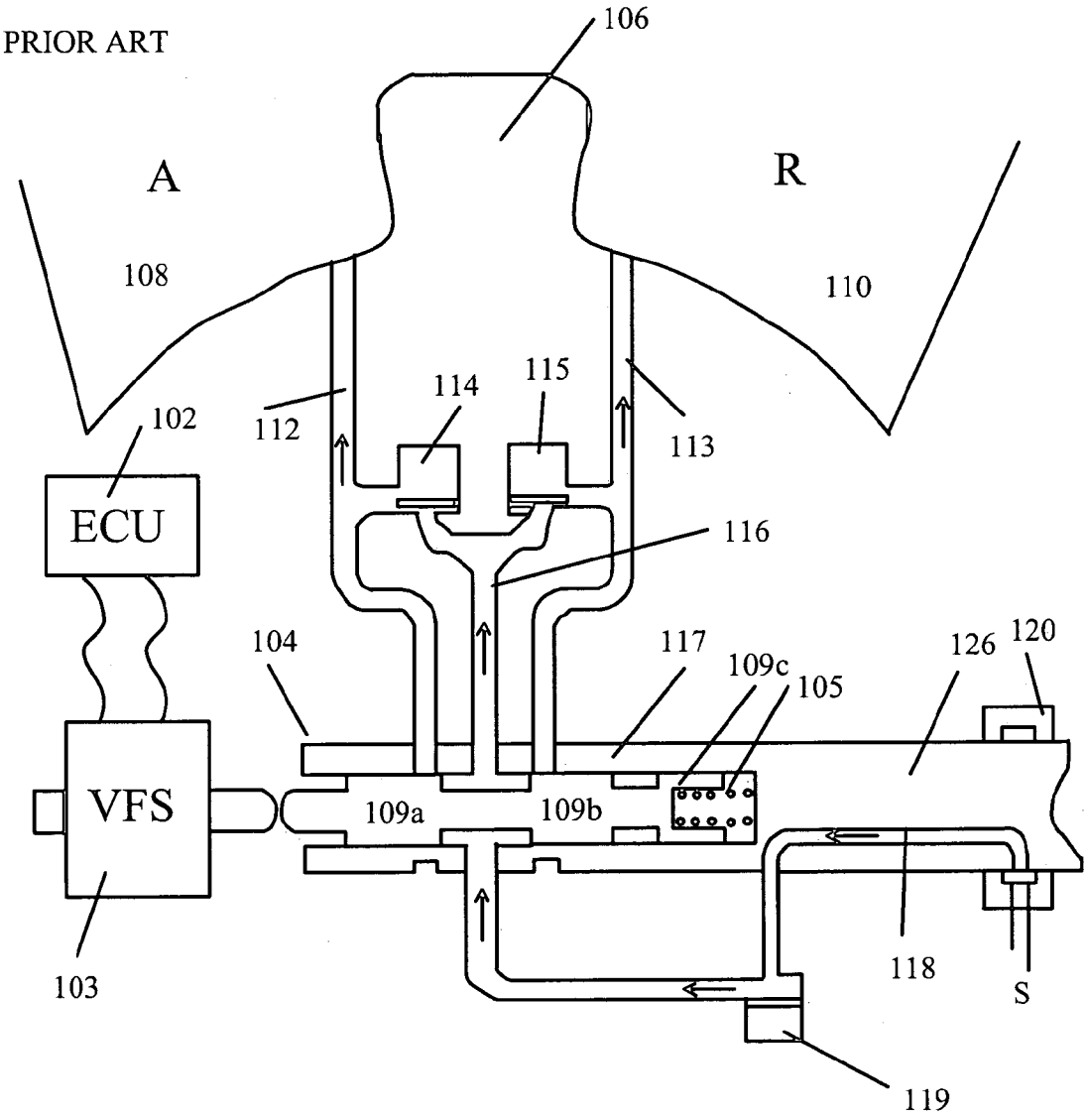
Fig. 1c PRIOR ART
FIG. 1*c* shows a schematic of a conventional cam torque actuated (CTA) phaser in the null position.
Figure 2A:
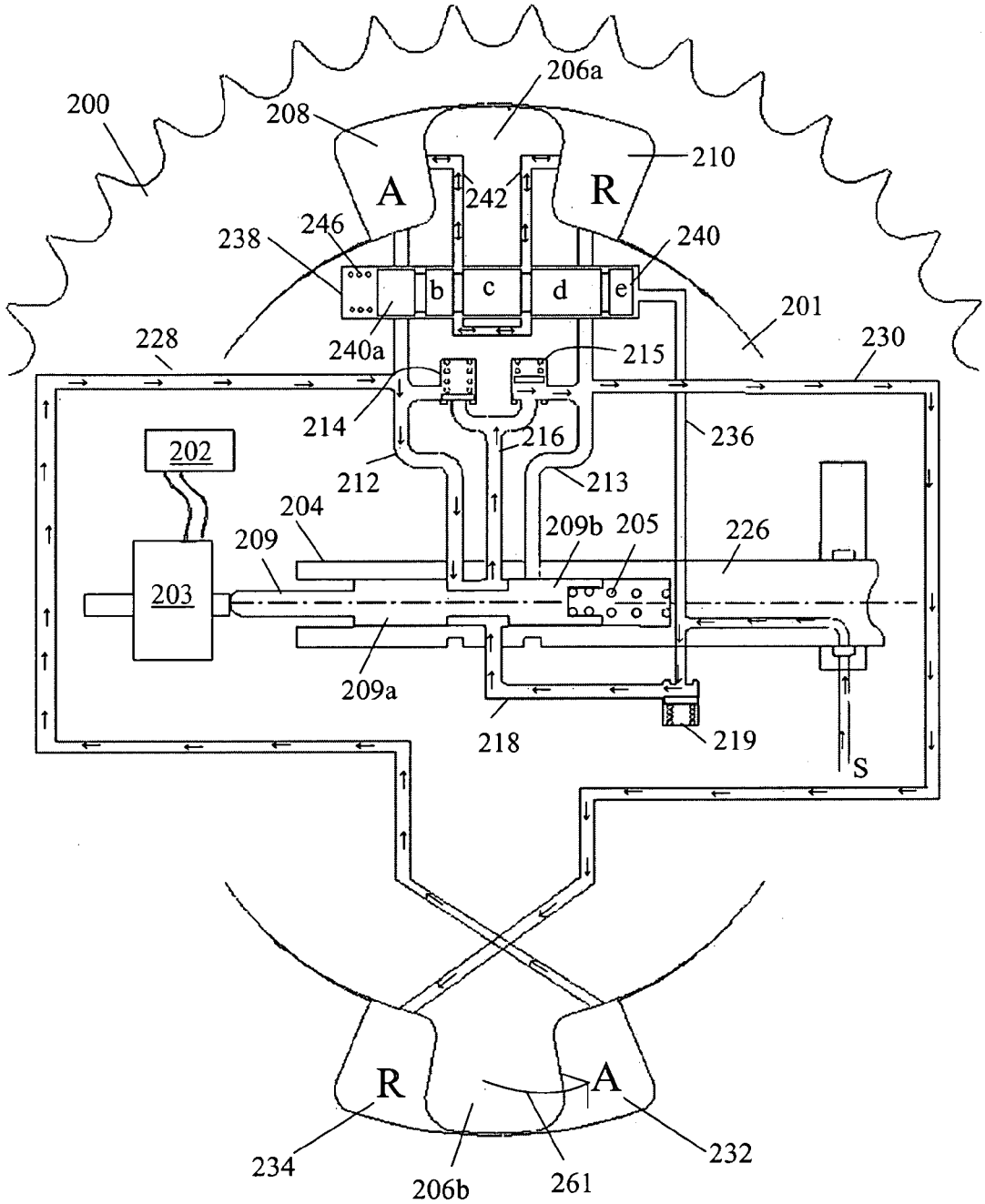
FIG. 2*a* shows a schematic of a cam torque actuated (CTA) phaser of the first embodiment shifting to a retard position with a switching valve in the first position.
Figure 2B:
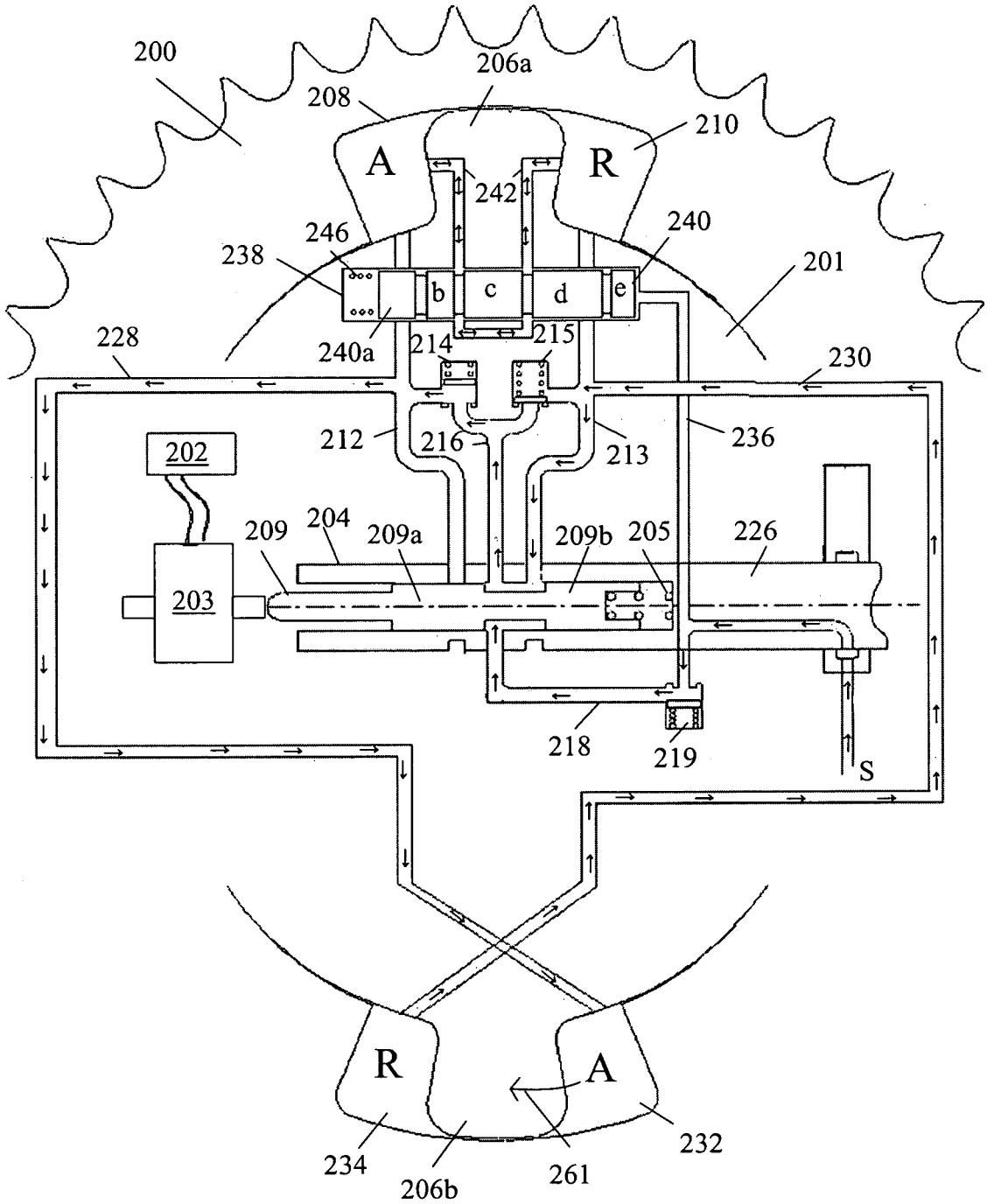
FIG. 2*b* shows a schematic of a cam torque actuated (CTA) phaser of the first embodiment shifting to an advance position with a switching valve in the first position.
Figure 2C:
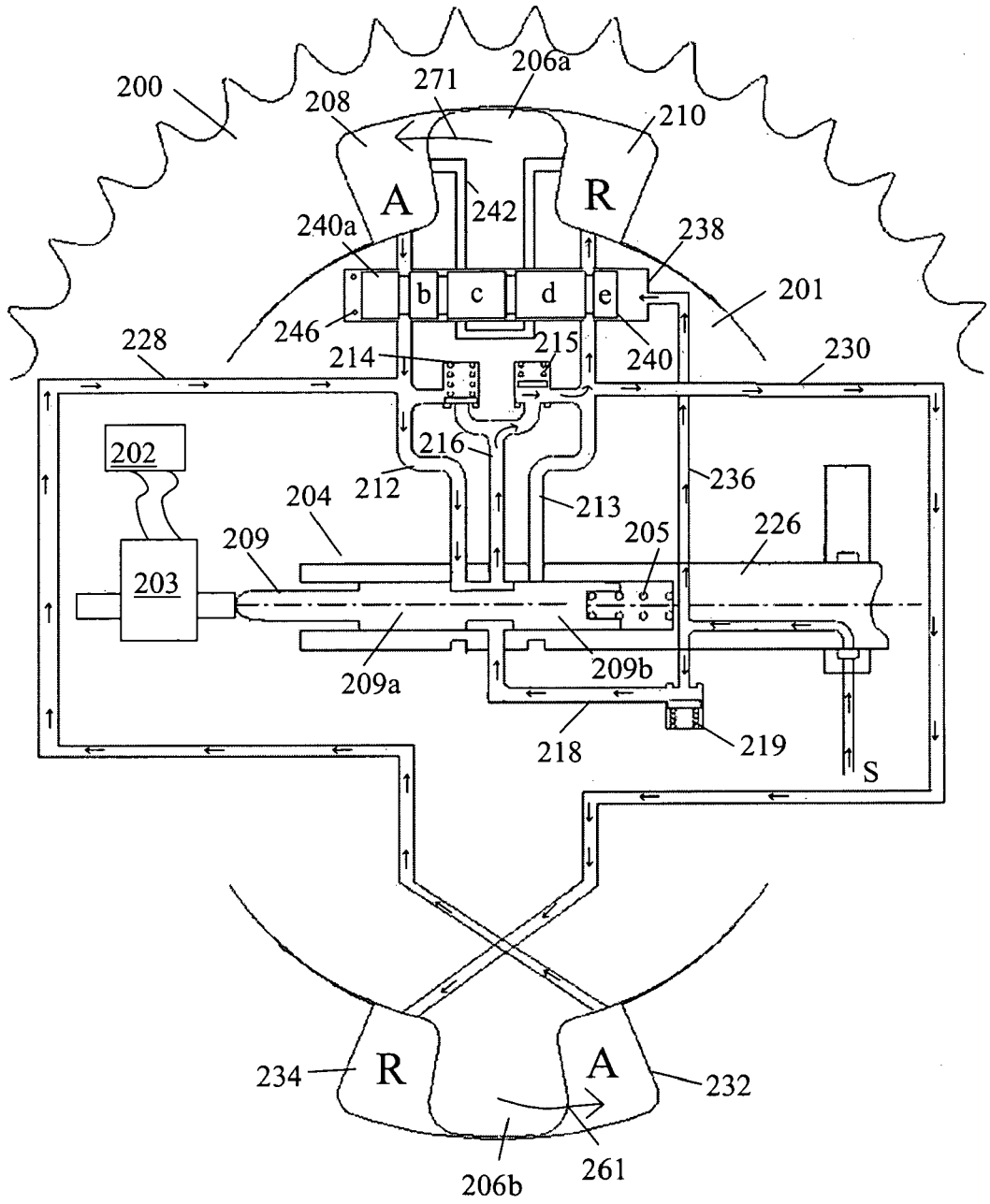
FIG. 2*c* shows a schematic of a cam torque actuated (CTA) phaser of the first embodiment shifting to a retard position with a switching valve in the second position.
Figure 2D:
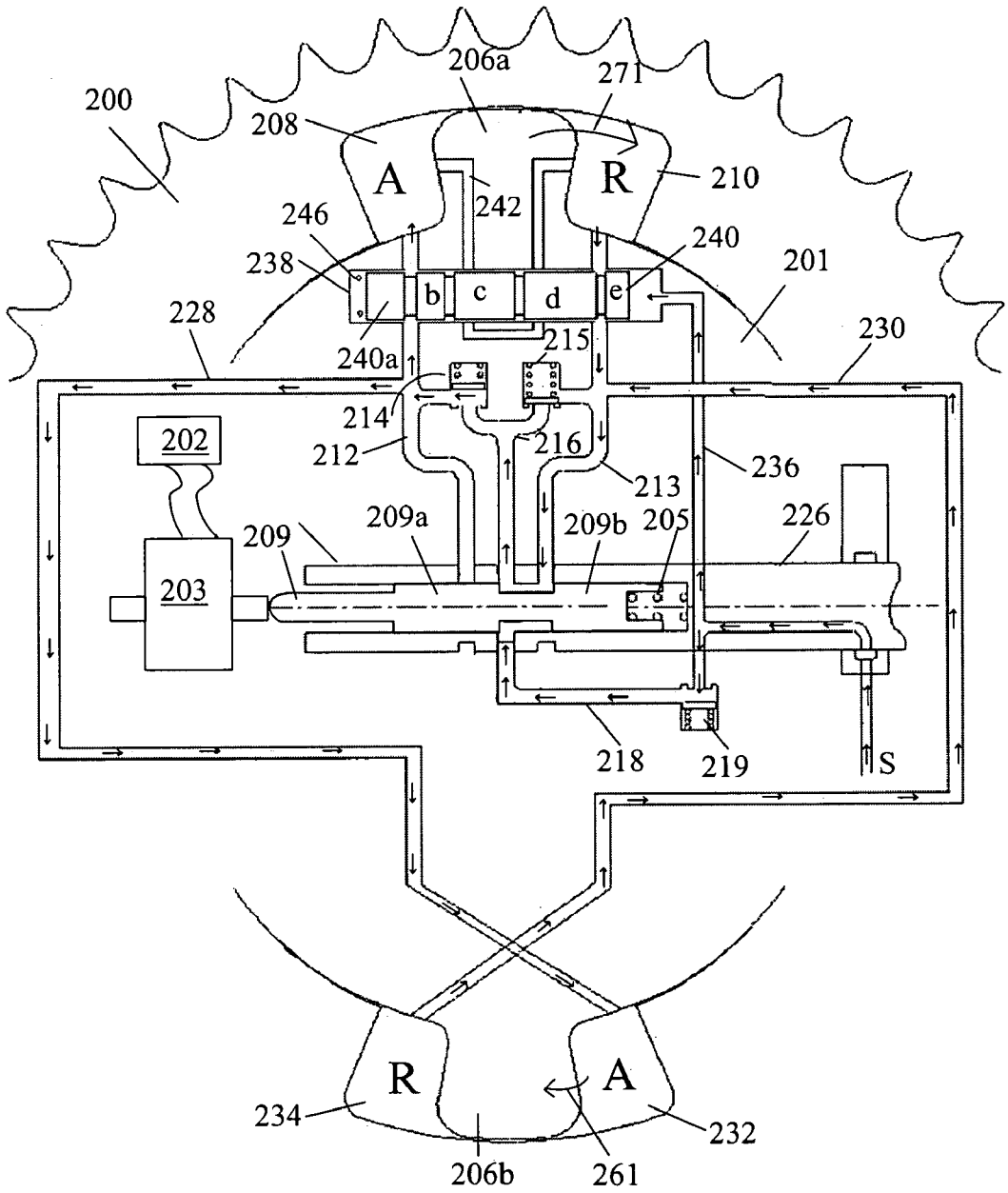
FIG. 2*d* shows a schematic of a cam torque actuated (CTA) phaser of the first embodiment shifting to an advance position with a switching valve in the second position.

FIG. 2*a* shows a schematic of a cam torque actuated phaser of the first embodiment, moving towards the retard position, with the switching valve in a first position. FIG. 2*b* shows a schematic of a cam torque actuated phaser of the first embodiment, moving towards the advance position, with the switching valve in a first position. FIG. 2*c* shows a schematic of a cam torque actuated phaser of the first embodiment, moving towards retard position, with a switching valve in the second position. FIG. 2*d* shows a schematic of a cam torque actuated phaser of the first embodiment, moving towards the advance position, with a switching valve in the second position.

Torque reversals in the camshaft caused by the forces of opening and closing engine valves move the vanes 206*a*, 206*b*. The advance and retard chambers 208, 210, 232, 234 are arranged to resist positive and negative torque pulses in the camshaft and are alternatively pressurized by the cam torque. The control valve 204 in the CTA system allows the vanes 206*a*, 206*b* in the phaser to move, by permitting fluid flow from the advance chambers 208, 232 to the retard chambers 232, 234 or vice versa, depending on the desired direction of movement, as shown in FIGS. 2*a* through 2*d*. Positive cam torsionals are used to move the phaser towards the retard position, as shown in FIGS. 2*a* and 2*c*. Negative cam torsionals are to move the phaser towards the advance position, as shown in FIGS. 2*b* and 2*d*.

The housing 200 of the phaser has an outer circumference for accepting drive force. The rotor 201 is connected to the camshaft 226 and is coaxially located within the housing 200. The rotor 201 has a first vane 206*a*, and a second vane 206*b*, with the first vane 206*a* separating a first chamber formed between the housing 200 and the rotor 201 into the first advance chamber 208 and first retard chamber 210, and the second vane 206*b* separating a second chamber formed between the housing 200 and the rotor 201 into the second advance chamber 232 and the second retard chamber 234. The first advance chamber 208 is directly connected to the first retard chamber 210 by passage 242. A switching valve 238 controls whether fluid is allowed into the first advance and retard chambers 208, 210 from lines 212, 213 and whether passage 242 is open between the first advance and first retard chambers 208, 210, allowing for direct fluid communication between them without any intervening structures or valve to prevent bidirectional fluid flow. The switching valve 238 is housed in a bore in the rotor 201 and has a spool 240 with a plurality of cylindrical lands 240*a*, 240*b*, 240*c*, 240*d*, and 240*e*. The spool 240 is biased by spring 246 and fluid in line 236. The first and second vanes 206*a*, 206*b* are capable of rotation to shift the relative angular position of the housing 200 and the rotor 201.

A phase control valve, preferably a spool valve 204, includes a spool 209 with cylindrical lands 209*a* and 209*b* slidably received in a bore in the rotor 201. The position of the spool 209 is influenced by spring 205 and a variable force solenoid (VFS) 203 controlled by the ECU 202. The position of the spool 209 controls the motion, (e.g. to move towards the advance position or the retard position) of the phaser.

In moving towards the retard position, as shown in FIG. 2*a*, the force of the VFS 203 was reduced and the spool 209 was moved to the left in the figure by spring 205, until the force of spring 205 balanced the force of the VFS 203. In the position shown, the line 213 is blocked by spool land 209*b*, and lines 212 and 216 are open. Camshaft torque pressurizes the second advance chamber 232, causing fluid in the second advance chamber 232 to move into the second retard chamber 234 and the vane 206*b* to move in the direction indicated by arrow 261. Fluid exits from the second advance chamber 232 through line 228 to line 212 and the spool valve 204 between spool lands 209*a* and 209*b* and recirculates back to central line 216, line 212, and line 230 leading to the second retard chamber 234. In addition, as stated earlier, positive cam torsionals are used to move the vane 206*b* in the direction shown by arrow 261.

Fluid is prevented from entering the first advance chamber 208 or the first retard chamber 210 by the switching valve 238. The spool 240 of the switching valve 238 is biased to a first position, shown in FIG. 2*a*, in which the force of the spring 246 is greater then the pressure of fluid available from line 236, which is connected to line 218 and supply S. In this position, any fluid that flows through line 212 to the first advance chamber 208 is blocked by spool land 240*a* of the switching valve 238 and any fluid that flows through line 213 to the first retard chamber 210 is blocked by spool land 240*d* of the switching valve 238. Any fluid that is present in the first advance 208 and retard chambers 210 recirculates directly between the chambers through passage 242 and switching valve 238 between lands 240*b* and 240*c* and 240*c* and 240*d*. The word "directly" meaning allowing for fluid communication between the chambers without any intervening structures or valve to prevent bidirectional fluid flow. Since fluid from the central line 216, the second advance chamber 232, and the second retard chamber 234 cannot reach the first advance chamber 208 and the first retard chamber 210, the chambers 208, 210 are deactivated or switched out of use and total active volume of the chambers of the phaser is limited to the active volume of the second advance chamber 232 and the active volume of the second retard chamber 234. The vane 206*a* separating the deactivated chambers 208, 210 is inactive. The vane 206*b* separating the active chambers 232, 234 is active Makeup oil is supplied to the phaser from supply to make up for leakage and enters line 218 and moves through inlet check valve 219 to the spool valve 204. From the spool valve 204 fluid enters line 216 through either of the check valves 214, 215, depending on which is open to either the second advance chamber 232 or the second retard chamber 234.

The position of the switching valve is independent, regardless of whether the phaser is moving towards the advance or retard position. FIG. 2*b* shows the phaser moving towards the advance position with the switching valve in the first position. To move towards the advance position, the force of the VFS 203 was increased and the spool 209 was moved to the right by the VFS 203, until the force of the spring 205 balances the force of the VFS 203. In the position shown, spool land 209*a* blocks line 212 and lines 213 and 216 are open. Camshaft torque pressurizes the second retard chamber 234, causing fluid in the second retard chamber 234 to move into the second advance chamber 232 and vane 206*b* to move in the direction indicated by arrow 261. Fluid exits from the second retard chamber 234 through line 230 to line 213, and the spool valve 204 between spool lands 209*a* and 209*b* and recirculates back to central line 216, line 212, and line 228 leading to the second advance chamber 232. As stated earlier, negative cam torsionals are used to move the vane 206*b* in the direction shown by arrow 261.

Fluid is prevented from entering the first advance chamber 208 or the first retard chamber 210 by the switching valve 238. The spool 240 of the switching valve 238 is biased to a first position, shown in FIG. 2*b*, in which the force of the spring 246 is greater then the pressure of fluid available from line 236, which is connected to line 218 and supply S. In this position, any fluid flow that flows through line 212 to the first advance chamber 208 is blocked by spool land 240*a* of the switching valve 238 and any fluid that flows through line 213 to the first retard chamber 210 is blocked by spool land 240*d* of the switching valve 238. Any fluid that is present in the first advance 208 and retard chambers 210 recirculates directly between the chambers through passage 242 and switching valve 238 between lands 240*b* and 240*c*, and 240*c* and 240*d*. The word "directly" meaning allowing for fluid communication between the chambers without any intervening structures or valve to prevent bidirectional fluid flow. Since fluid from the central line 216, the second advance chamber 232, and second retard chamber 234 cannot reach the first advance chamber 208 and the first retard chamber 210, the chambers 208, 210 are deactivated or switched out of use and the total active volume of the chambers of the phaser is limited to the active volume of the second advance chamber 232 and the active volume of the second retard chamber 234. The vane 206*a* separating the deactivated chambers 208, 210 is inactive. The vane 206*b* separating the active chambers 232, 234 is active Makeup oil is supplied to the phaser from supply to make up for leakage and enters line 218 and moves through inlet check valve 219 to the spool valve 204. From the spool valve 204 fluid enters line 216 through either of the check valves 214, 215, depending on which is open to either the second advance chamber 232 or the second retard chamber 234.

FIG. 2*c* shows the cam torque actuated phaser moving towards the retard position and the switching valve in the second position. When the switching valve is in the second position, the total active volume of the phaser increases from two chambers to four chambers. The switching valve is moved from the first position to the second position when the pressure of the fluid from the supply line 218 and in line 236 is greater than the force of spring 246, until the pressure of the fluid line 236 is equal to the force of spring 246. Spool lands 240*c* and 240*d* block passage 242 and open lines 212 and 213 to the first advance chamber 208 and the first retard chamber 210, respectively.

In moving towards the retard position, as shown in FIG. 2*c*, the force of the VFS 203 was reduced and the spool 209 was moved to the left in the figure by spring 205, until the force of the spring 205 balances the force of the VFS 203. In the position shown, spool land 209*b* blocks line 213, and lines 212 and 216 are open. Camshaft torque pressurizes the first advance chamber 208 and the second advance chamber 232, causing fluid in the first advance chamber 208 and the second advance chamber 232, to move into the first retard chamber 210 and the second retard chamber 234, respectively and vanes 206*a* and 206*b* to move in the direction indicated by arrows 261 and 271 respectively. Fluid exits from the first advance chamber 208 through line 212 and the switching valve 240 between spool lands 240*a* and 240*b* to the spool valve 204 between lands 209*a* and 209*b* and recirculates back to central line 216 and the first retard chamber 210. Fluid also exits from the second advance chamber 232 through line 228 to line 212 and the spool valve 204 between spool lands 209*a* and 209*b* and recirculates back to central line 216 and the second retard chamber 234. Fluid is prevented from directly circulating between the first advance chamber 208 and the first retard chamber 210 by blocking passage 242 with lands 240*c* and 240*d* of the switching valve 238. The word "directly" meaning allowing for fluid communication between the chambers without any intervening structures or valve to prevent bidirectional fluid flow.

Since fluid from the central line 216 and the second advance chamber 232 and second retard chamber 234 can reach the first advance chamber 208 and the first retard chamber 210, chambers 208, 210 are activated or switched into use and the total active volume of the chambers of the phaser includes all of the chambers 208, 210, 232, 234. The vanes 206*a*, 206*b* separating the active chambers 208, 210 and 232, 234 that are active.

Makeup oil is supplied to the phaser from supply to make up for leakage and enters line 218 and moves through inlet check valve 219 to the spool valve 204. From the spool valve 204 fluid enters line 216 through either of the check valves 214, 215, depending on which is open to either the first advance chamber 208 and the second advance chamber 232, or the first retard chamber 234 and the second retard chamber 210.

Since the position of the switching valve is independent of phaser position, FIG. 2*d* shows the phaser moving towards the advance position with the switching valve in the second position. When the switching valve is in the second position, the total active volume of the phaser increases from two chambers to four chambers. The switching valve is moved from the first position to the second position when the pressure of fluid from the supply line 218 and in line 236 is greater than the force of spring 246, until the pressure of the fluid line 236 is equal to the force of spring 246. Spool lands 240*c* and 240*d* block passage 242 and open lines 212 and 213 to the first advance chamber 208 and the first retard chamber 210, respectively.

In moving towards the advance position, as shown in FIG. 2*d*, the force of the VFS 203 was increased and the spool 209 was moved to the right in the figure by the VFS 203, until the force of spring 205 balances the force of the VFS 203. In the position shown, spool land 209*a* blocks line 212, and lines 213 and 216 are open. Camshaft torque pressurizes the first retard chamber 210 and the second retard chamber 234, causing fluid in the first retard chamber 210 and the second retard chamber 234, to move into the first advance chamber 208 and the second advance chamber 232, respectively and vanes 206*a* and 206*b* to move in the direction indicated by arrows 261 and 271 respectively. Fluid exits from the first retard chamber 210 through line 213 and the switching valve 238 between spool lands 240*d* and 240*e* to the spool valve 204 between lands 209*a* and 209*b* and recirculates back to central line 216 and the first advance chamber 208. Fluid also exits from the second retard chamber 234 through line 230 to line 213 and the spool valve 204 between spool lands 209*a* and 209*b* and recirculates back to central line 216 and the second advance chamber 232. Fluid is prevented from directly circulating between the first advance chamber 208 and the first retard chamber 210 by blocking passage 242 with lands 240*c* and 240*d* of the switching valve 238. The word "directly" meaning allowing for fluid communication between the chambers without any intervening structures or valve to prevent bidirectional fluid flow.

Since fluid from the central line 216 and the second advance chamber 232 and second retard chamber 234 can reach the first advance chamber 208 and the first retard chamber 210, chambers 208, 210 are activated or switched into use and the total active volume of the chambers of the phaser includes all of the chambers 208, 210, 232, 234. The vanes 206*a*, 206*b* separating the activated chambers 208, 210 and 232, 234 that are active.

Makeup oil is supplied to the phaser from supply to make up for leakage and enters line 218 and moves through inlet check valve 219 to the spool valve 204. From the spool valve fluid enters line 216 through either of the check valves 214, 215, depending on which is open, to either the first advance chamber 208 and the second advance chamber 232, or the first retard chamber 210 and the second retard chamber 234.

The increasing pressure of fluid to the switching valve in the above embodiment is preferably related to engine oil pressure. Alternatively, the increasing pressure may be related to the ECU in which an additional regulator valve would be present to increase the amount of pressure. For example in the first embodiment when the switching valve 238 is in the first position, the engine may have less torsional energy available, especially during engine start up and at low speeds when engine oil pressure is low. When the engine has more torsional energy available, the switching valve 238 may be placed in the second position, as in the first embodiment, increasing the active volume of the phaser needed for optimum performance of the phaser.

In the rest of the embodiments of the present application, the first and second positions of the switching valve will be shown in phasers either in or moving towards the advance position of the phaser only. As noted in the first embodiment, the position of the switching valve is independent of the position of the spool valve and the first and second positions of the switching valve may occur in both the advance and the retard positions. In the rest of the embodiments, one skilled in the art would understand how the phasers would be moved from the advance position shown, to the retard position, regardless of which position the switching valve is in.

Figure 3A:
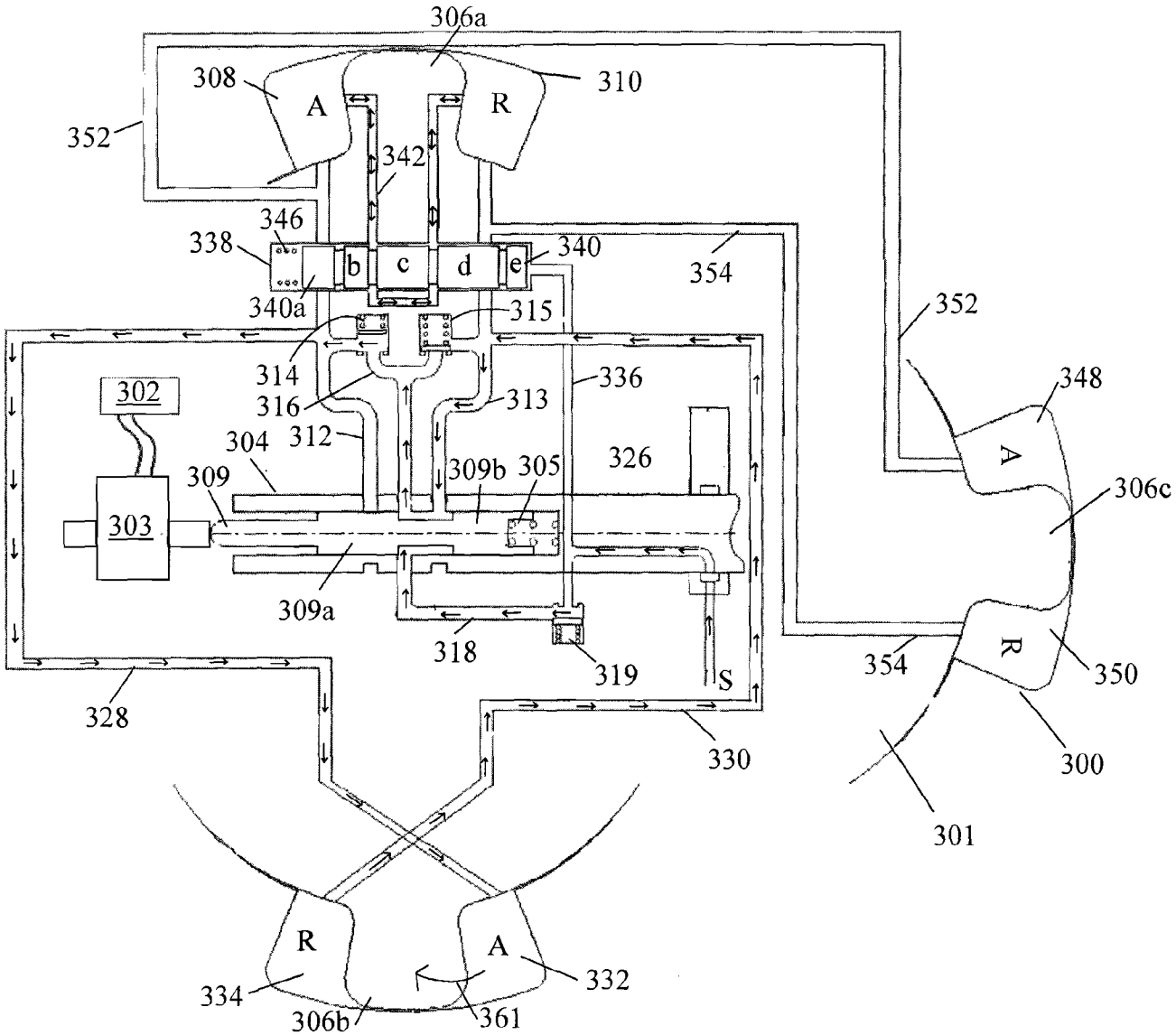
FIG. 3*a* shows a schematic of a cam torque actuated (CTA) phaser of the second embodiment shifting to an advance position with a switching valve in a first position.
Figure 3B:
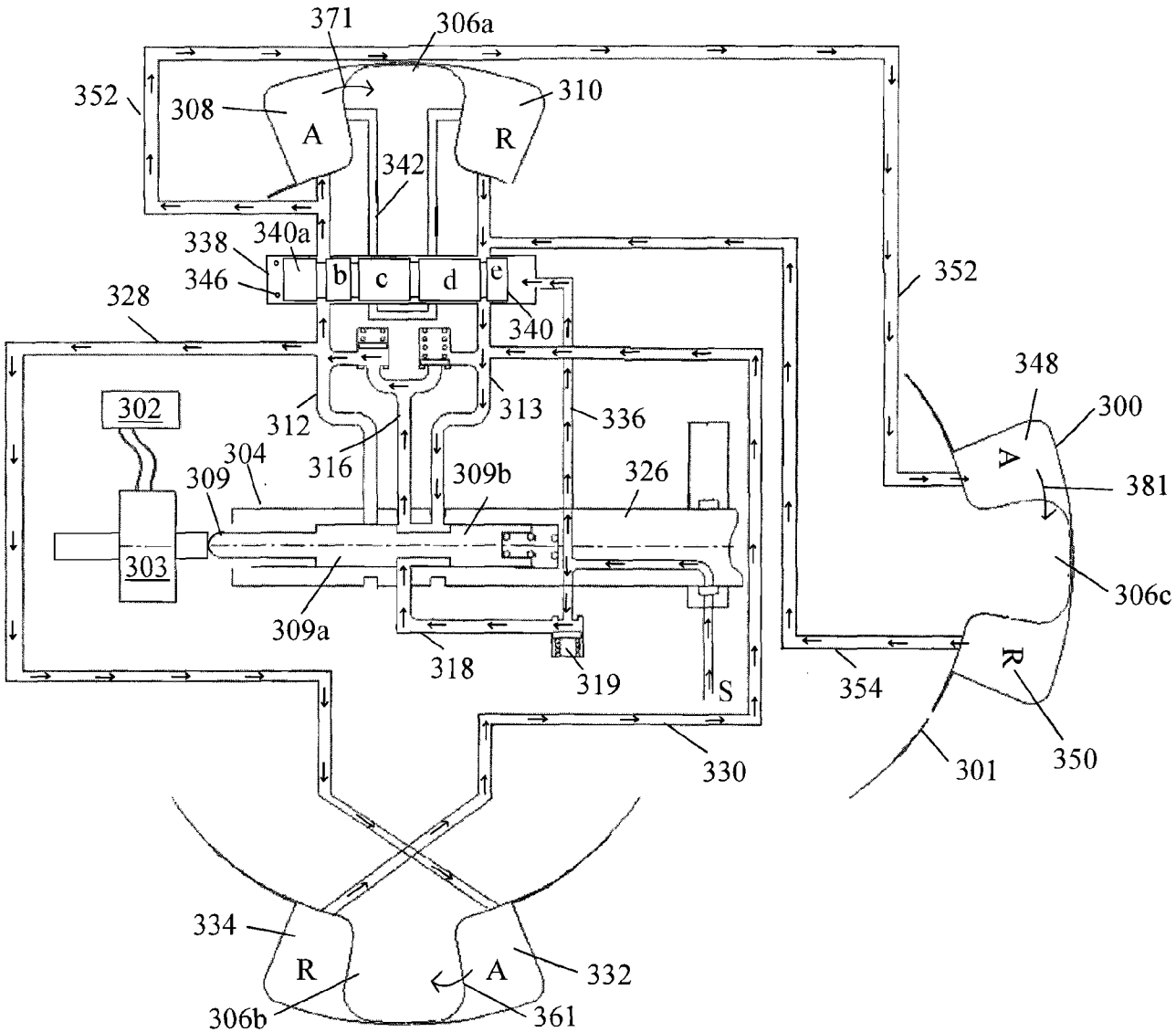
FIG. 3*b* shows a schematic of a cam torque actuated (CTA) phaser of the second embodiment shifting to an advance position with a switching valve in a second position.

FIG. 3*a* shows a cam torque actuated (CTA) phaser of the second embodiment, moving towards the advance position, with the switching valve in the first position. FIG. 3*b* shows the cam torque actuated (CTA) phaser of the second embodiment, moving towards the advance position, with the switching valve in the second position.

Torque reversals in the camshaft caused by the forces of opening and closing engine valves move the vanes 306*a*, 306*b*, and 306*c*. The advance and retard chambers 308, 310, 332, 334, 348, 350 are arranged to resist positive and negative torque pulses in the camshaft and are alternatively pressurized by the cam torque. The control valve 304 in the CTA system allows the vanes 306*a*, 306*b*, 306*c* in the phaser to move, by permitting fluid flow from the advance chambers 308, 332, 348 to the retard chambers 310, 334, 350 or vice versa, depending on the desired direction of movement. Negative cam torsionals are used to move the phaser towards the advance position, as shown in FIGS. 3*a* and 3*b*. The phaser also uses positive cam torsionals to move the phaser towards the retard position, which is not shown.

The housing 300 of the phaser has an outer circumference for accepting drive force. The rotor 301 is connected to the camshaft 326 and is coaxially located within the housing 300. The rotor 301 has a first vane 306*a*, a second vane 306*b*, and a third vane 306*c*, with the first vane 306*a* separating a first chamber formed between the housing 300 and the rotor 301 into the first advance chamber 308 and the first retard chamber 310, the second vane 306*b* separating a second chamber formed between the housing 300 and the rotor 301 into the second advance chamber 332 and the second retard chamber 334, and a third vane 306*c* separating a third chamber formed between the housing 300 and the rotor 301 into the third advance chamber 348 and the third retard chamber 350. The third vane 306*c* may be connected in parallel to the first vane 306*a*. The first advance chamber 308 is directly connected to the first retard chamber 310 by passage 342. The word "directly" meaning allowing for fluid communication between the chambers without any intervening structures or valve to prevent bidirectional fluid flow. The first advance and retard chambers 308, 310 are connected to the third advance and retard chambers 348, 350 for direct recirculation of fluid through lines 352 and 354, which branch off from lines 312 and 313, respectively. A switching valve 338 controls the opening and closing of passage 342 and whether fluid is allowed into the first advance and retard chambers 308, 310 from lines 312 and 313 and subsequently the third advance and retard chambers 348, 350 from lines 312, 313, 352, and 354, allowing direct fluid communication between them. The switching valve 338 is housed in a bore in the rotor 301 and has a spool 340 with a plurality of cylindrical lands 340*a*, 340*b*, 340*c*, 340*d*, and 340*e*. The spool 340 is biased by spring 346 and fluid in line 336. The first, second, and third vanes 306*a*, 306*b*, 306*c* are capable of rotation to shift the relative angular position of the housing 300 and the rotor 301.

A phase control valve, preferably a spool valve 304 includes a spool 309 with cylindrical lands 309*a* and 309*b* slidably received in a bore in the rotor 301. The position of the spool 309 is influenced by spring 305 and a variable force solenoid (VFS) 303 controlled by the ECU 302. The position of the spool 309 controls the motion (e.g. to move towards the advance position or the retard position) of the phaser.

In moving towards the advance position, as shown in FIG. 3*a*, the force of the variable force solenoid (VFS) 303 was increased and the spool 309 was moved to the right by VFS 303, until the force of the spring 305 balances the force of the VFS. 303. In the position shown, spool land 309*a* blocks line 312, and lines 313 and 316 are open. Camshaft torque pressurizes the second retard chamber 334, causing fluid in the second retard chamber 334 to move into the second advance chamber 332. Fluid exits the second retard chamber 334 through line 313 and 330 and moves through the spool valve 304 between spool lands 309*a* and 309*b*. From the spool valve 304, fluid enters line 316 and travels through open check valve 314 into lines 312 and 328 to the second advance chamber 332.

Fluid is prevented from entering the first advance chamber 308, the first retard chamber 310, the third advance chamber 348, or the third retard chamber 350 by switching valve 338. The spool 340 of the switching valve 338 is biased to a first position in which the force of the spring 346 is greater than the pressure of the fluid available from line 336. In this position, any fluid flow through line 312 to the first advance chamber 308 and the third advance chamber 348 is blocked by spool land 340*a* of the switching valve 338 and any fluid flow through line 313 to the first retard chamber 310 and the third retard chamber 350 is blocked by spool land 340*d* of the switching valve 338. Any fluid that is present in the first advance chamber 308, the first retard chamber 310, the third advance chamber 348, and the third retard chamber 350 recirculates directly between the chambers by passages, 342, 352, and 354. The word "directly" meaning allowing for fluid communication between the chambers without any intervening structures or valve to prevent bidirectional fluid flow. Direct recirculation of fluid between the first advance chamber 308 and the first retard chamber 310 moves through passage 342 and switching valve 338 between lands 340*b* and 340*c*, and 340*c* and 340*d*. Since fluid from the central line 316 and the second advance 332 and second retard chamber 334 cannot reach the first advance chamber 308, the first retard chamber 310, the third advance chamber 348, or the third retard chamber 350, the chambers 308, 310, 348, 350 are deactivated or switched out of use and the total active volume of the chambers of the phaser is limited to the active volume of the second advance chamber 332 and the active volume of the second retard chamber 334. The vane 306*a* separating the deactivated chambers 308, 310 and the vane 306*c* separating deactivated chambers 348, 350 that is inactive. The vane 306*b* separating the active chambers 332, 334 is active.

Makeup oil is supplied to the phaser from supply to make up for leakage and enters line 318 and moves through inlet check valve 319 to the spool valve 304. From the spool valve 304 fluid enters line 316 through either of the check valves 314, 315, depending on which is open to either the second advance chamber 332 or the second retard chamber 334.

FIG. 3*b* shows the cam torque actuated phaser moving towards the advance position and the switching valve in the second position. When the switching valve is in the second position, the total active volume of the phaser increases from two chambers to six chambers. The switching valve is moved from a first position to a second position when the pressure of fluid in line 336 is greater than the force of the spring 346. In this position, spool lands 340*c* and 340*d* block passage 342 and open lines 312 and 352 to the first advance chamber 308, and the third advance chamber 348 respectively, and open lines 313 and 354 to the first retard chamber 310 and the third retard chamber 350, respectively.

In moving towards the advance position, the force of the variable force solenoid (VFS) 303 was increased and the spool 309 was moved to the right in the figure by the VFS 303, until the force of the spring 305 balances the force of the VFS 303. In the position shown, spool land 309*a* blocks line 312 and lines 313 and 316 are open. Camshaft torque pressurizes the first retard chamber 310, the second retard chamber 334, and the third retard chamber 350, causing fluid in the first retard chamber 308, the second retard chamber 332, and the third retard chamber 350 respectively, to move into the first advance chamber 308, the second advance chamber 334, and the third advance chamber 348, respectively and vanes 306*a*, 306*b*, and 306*c* to move in the directions indicated by arrows 371, 361, and 381. Fluid exits from the first retard chamber 310 through line 313 and the switching valve 338 between spool lands 340*d* and 340*e* to the spool valve 304 between spool lands 309 and 309*b* and recirculates back to central line 316 and the first advance chamber 308. Fluid exiting from the third retard chamber 350 and flows through line 354 to line 313 and the switching valve 338, following the same path as fluid exiting from the first retard chamber 310. Fluid also exits from the second retard chamber 334 through line 330 to line 313 and the spool valve 304 between lands 309*a* and 309*b* and recirculates back to central line 316 and the second advance chamber 334. Fluid is prevented from directly recirculating between the first advance chamber 308 and the first retard chamber 310 by blocking passage 342 with lands 340*c* and 340*d* of the switching valve 338. The word "directly" meaning allowing for fluid communication between the chambers without any intervening structures or valve to prevent bidirectional flow.

Since fluid from the central line 316 and the second advance chamber 332 and second retard chamber 334 can reach the first advance chamber 308, the first retard chamber 310, the third advance chamber 348, and the third retard chamber 350, the chambers 308, 310, 348, 350 are activated or switched into use and the total active volume of the chambers of the phaser includes all of the chambers 308, 310, 332, 334, 348, 350. The vanes 306*a*, 306*b*, 306*c* separating the activated chambers 308, 310, 332, 334, 348, 350 are active.

Makeup oil is supplied to the phaser from supply to make up for leakage and enters line 318 and moves through inlet check valve 319 to the spool valve 304. From the spool valve 304 fluid enters line 316 through either of the check valves 314, 315, depending on which is open, either the first advance chamber 308, the second advance chamber 332, and the third advance chamber 348, or the first retard chamber 310, the second retard chamber 334, and the third retard chamber 350.

The increasing pressure of fluid to the switching valve in the above embodiment is preferably related to engine oil pressure. Alternatively, the increasing pressure may be related to the ECU in which an additional regulator valve would be present to increase the amount of pressure. For example in the first embodiment when the switching valve 338 is in the first position, the engine may have less torsional energy available, especially during engine start up and at low speeds when engine oil pressure is low. When the engine has more torsional energy available, the switching valve 338 may be placed in the second position, as in the first embodiment, increasing the active volume of the phaser needed for optimum performance of the phaser.

Figure 4A:
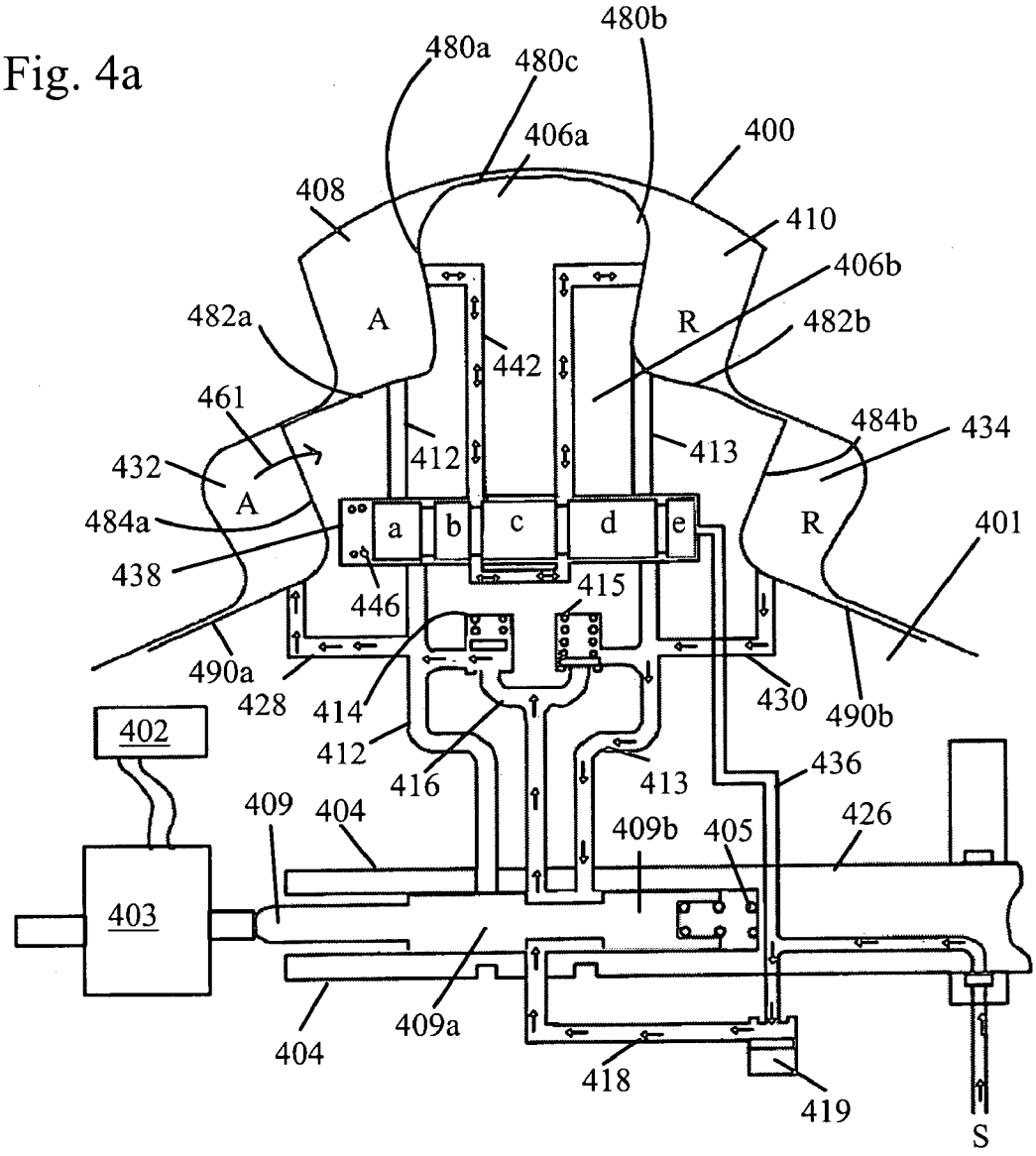
FIG. 4*a* shows a schematic of a cam torque actuated (CTA) phaser of the third embodiment shifting to an advance position with a switching valve in a first position.
Figure 4B:
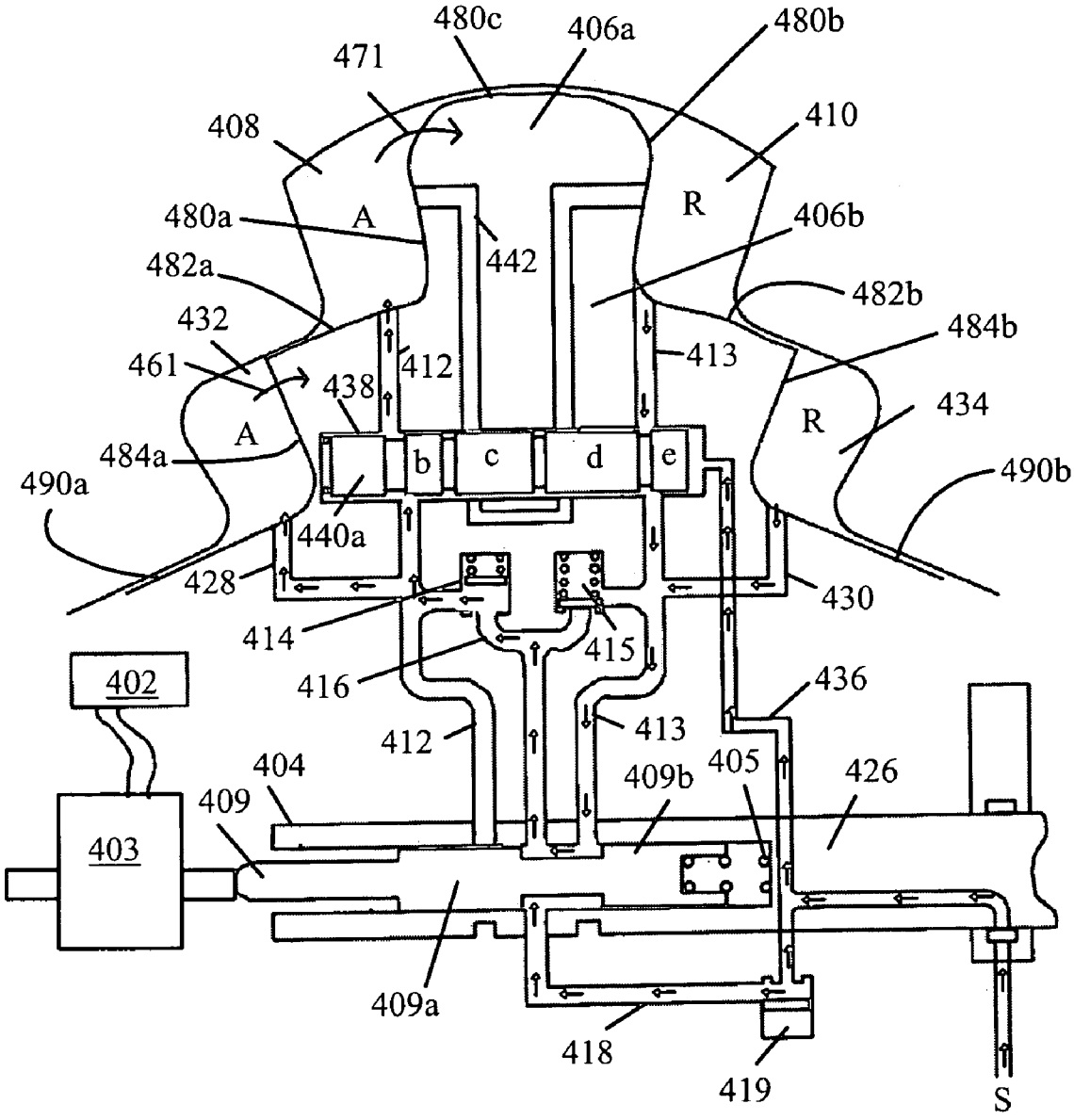
FIG. 4*b* shows a schematic of a cam torque actuated (CTA) phaser of the third embodiment shifting to an advance position with a switching valve in a second position.

FIG. 4*a* shows a cam torque actuated (CTA) phaser of a third embodiment, moving towards the advance position, with the switching valve in the first position. FIG. 4*b* shows a cam torque actuated (CTA) phaser of the third embodiment, moving towards the advance position, with the switching valve in the second position.

Torque reversals in the camshaft caused by the forces of opening and closing engine valves move the vanes 406*a* and 406*b*. The advance and retard chambers 408, 410, 432, 434 are arranged to resist positive and negative torque pulses in the camshaft and are alternatively pressurized by the cam torque. The control valve 404 in the phaser allows the vanes 406*a*, 406*b* in the phaser to move, by permitting fluid flow from the advance chambers 408, 432 to the retard chambers 410, 434 or vice versa, depending on the desired direction of movement. Negative cam torsionals are used to move the phaser towards the advance position, as shown in FIGS. 4*a* and 4*b*. The phaser also uses positive cam torsionals to move the phaser towards the retard position, which is not shown.

The housing 400 of the phaser has an outer circumference for accepting drive force. The rotor 401 is connected to the camshaft 426 and is coaxially located within the housing 400. The rotor 401 defines a first vane 406*a* with an upper surface 480*c* and a pair of upper vane side walls 480*a*, 480*b* that leads into a pair of shoulders 482*a*, 482*b*. The shoulders 482*a*, 482*b* seal the first advance chamber 408 and the first retard chamber 410 from the second advance chamber 432 and the second retard chamber 434 and are the upper surfaces of the second vane 406*b*. The first advance chamber 408 is defined by a first upper vane side wall 480*a* of the vane 406*a*, the housing 400, and shoulder 482*a*. The first retard chamber 410 is defined by the second upper vane side wall 480*b* of the vane 406*a*, the housing 400, and shoulder 482*b*. The second vane 406*b* has a pair of lower vane side walls 484*a*, 484*b* and bottom walls 490*a*, 490*b*. The bottom walls 490*a*, 490*b* seal the second advance chamber 432 and the second retard chamber 434 from the rest of the phaser. The second advance chamber 432 is defined by a first lower vane side wall 484*a*, the housing 400, and bottom wall 490*a*. The second retard chamber 434 is defined by a second lower vane side wall 484*b*, the housing 400, and bottom wall 490*b*.

The first advance chamber 408 is directly connected to the first retard chamber 410 by passage 442. The word "directly" meaning allowing for fluid communication between the chambers without any intervening structures or valve to prevent bidirectional fluid flow. A switching valve 438 controls whether fluid is allowed into the first advance chamber 408 and the first retard chamber 410 from lines 412, 413 and whether passage 442 is open between the first advance and retard chambers 408, 410, allowing direct fluid communication between the first advance chamber 408 and the first retard chamber 410. The switching valve 438 is housed in a bore in the rotor 401 and has a spool 440 with a plurality of cylindrical lands 440*a*, 440*b*, 440*c*, 440*d*, and 440*e*. The spool 440 is biased by spring 446 and fluid in line 436. The first and second vanes 406*a*, 406*b* are capable of rotation to shift the relative angular position of the housing 400 and the rotor 401.

A phase control valve, preferably a spool valve 404 includes a spool 409 with cylindrical lands 409*a* and 409*b* and is slidably received in a bore in the rotor 401. The position of the spool 409 is influenced by spring 405 and a variable force solenoid (VFS) 403 controlled by the ECU 402. The position of the spool 409 controls the motion (e.g. to move towards the advance position or the retard position) of the phaser.

In moving towards the advance position, as shown in FIG. 4*a*, the force of the variable force solenoid 403 was increased and the spool 409 was moved to the right by VFS 403, until the force of the spring 405 balances the force of the VFS 403. In the position shown, spool land 409*a* blocks line 412, and lines 413 and 416 are open. Camshaft torque pressurizes the second retard chamber 434, causing fluid in the second retard chamber 434 to move into the second advance chamber 432. Fluid exits the second retard chamber 434 through line 413 and 430 and moves to the spool valve 404 between spool lands 409*a* and 409*b*. From the spool valve 404, fluid enters line 413 and travels through open check valve 414 into lines 412 and 428 to the second advance chamber 432.

Fluid is prevented from entering the first advance chamber 408 and the first retard chamber 410 by the switching valve 438. The spool 440 of the switching valve 438 is biased to a first position in which the force of the spring 446 is greater than the pressure of fluid available from line 436. In this position, any fluid flow through line 412 to the first advance chamber 408 is blocked by spool land 440*a* of the switching valve 438 and any fluid flow through line 413 to the first retard chamber 410 is blocked by spool land 440*d* of the switching valve 438. Any fluid that is present in the first advance chamber 408 and the first retard chambers 410 recirculates directly between the chambers through passage 442 and between switching valve lands 440*b*, 440*c*, and 440*c* and 440*d*. The word "directly" meaning allowing for fluid communication between the chambers without any intervening structures or valves to prevent bidirectional fluid flow. Since fluid from the central line 416, the second advance chamber 432, and the second retard chamber 434 cannot reach the first advance chamber 408 and the first retard chamber 410, the chambers 408, 410 are deactivated or switched out of use and the total active volume of the chambers of the phaser is limited to the active volume of the second advance chamber 432 and the active volume of the second retard chamber 434. The vane 406*a* separating the deactivated chambers 408, 410 is inactive. The vane 406*b* separating the active chambers 432, 434 is active.

Makeup oil is supplied to the phaser from supply to make up for leakage and enters line 418 and moves through inlet check valve 419 to the spool valve 404. From the spool valve fluid enters line 416 through either of the check valves 414, 415, depending on which is open and either the second advance chamber 432 or the second retard chamber 434.

FIG. 4*b* shows the cam torque actuated phaser moving towards the advance position and the switching valve in the second position. When the switching valve is in the second position, the total active volume of the phaser increases from two chambers to four chambers. The switching valve is moved from the first position to the second position, when the pressure of the fluid in line 436 is greater than the force of the spring 446. Spool lands 440*c* and 440*d* block passage 442 and opens line 412 to the first advance chamber 408 and line 413 to the first retard chamber 410.

In moving towards the advance position, the force of the variable force solenoid (VFS) 403 was increased and the spool 409 was moved to the right in the figure by the VFS 403, until the force of the spring 405 balances the force of the VFS 403. In the position shown, spool land 409*a* blocks line 412 and lines 413 and 416 are open. Camshaft torque pressurizes the first retard chamber 410 and the second retard chamber 434, causing fluid in the first retard chamber 410, and the second retard chamber 434 respectively, to move into the first advance chamber 408, and the second advance chamber 432, respectively and vanes 406*a*, 406*b* to move in the directions indicated by arrows 471 and 461. Fluid exits from the first retard chamber 410 through line 413 and switching valve 438 between spool lands 440*d* and 440*e* to the spool valve 404 between spool lands 409*a* and 409*b* and recirculates back to the central line 416 and the first advance chamber 408. Fluid also exits from the second retard chamber 434 through line 430 to line 413 and the spool valve 404 between lands 409*a* and 409*b* and recirculates back to central line 416 and the second advance chamber 432. Fluid is prevented from directly recirculating between the first advance chamber 408 and the first retard chamber 410 by blocking passage 442 with lands 440*c* and 440*d* of the switching valve 438. The word "directly" meaning allowing for fluid communication between chambers without any intervening structures of valve to prevent bidirectional flow.

Since fluid from the central line 416, the second advance chamber 432, and the second retard chamber 434 can reach the first advance chamber 408 and the first retard chamber 410, the chambers 408, 410 are activated or switched into use and the total active volume of the chambers of the phaser includes all of the chambers 408, 410, 432, 434. The vanes 406*a*, 406*b* separating the activated chambers 408, 410, 432, 434, are active.

Makeup oil is supplied to the phaser from supply to make up for leakage and enters line 418 and moves through inlet check valve 419 to the spool valve 404. From the spool valve 404 fluid enters line 416 through either of the check valves 414, 415, depending on which is open either the first advance chamber 408 and the second advance chamber 432 or the first retard chamber 410 and the second retard chamber 434.

The phaser of the above embodiment may contain additional passages as shown in FIGS. 10*a*, 10*b*, 11*a*, and 11*b*.

Figure 5:
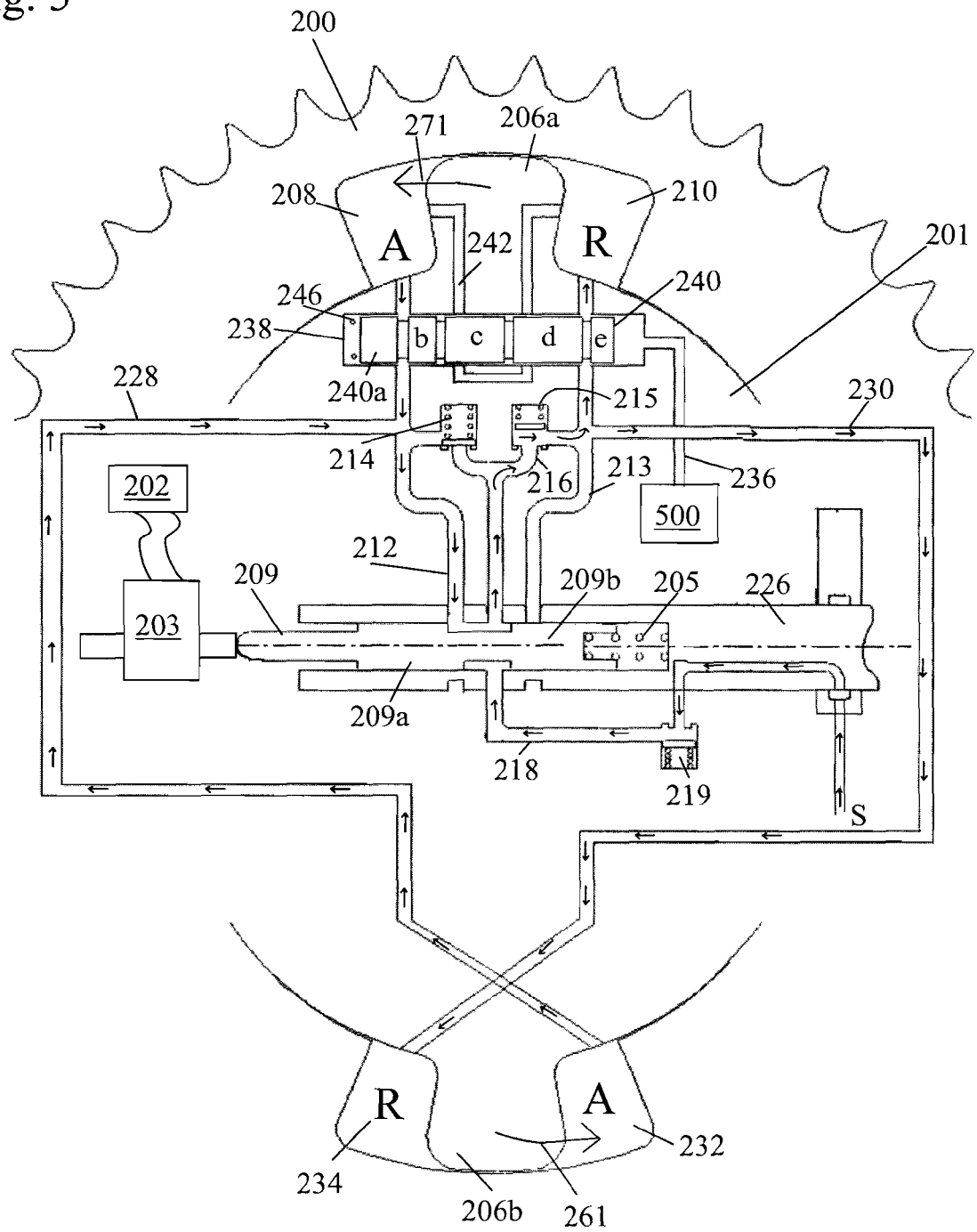
FIG. 5 shows a schematic of a phaser of another embodiment showing the actuator of the switching valve.

FIG. 5 shows the phaser of the first embodiment shown in FIG. 2*b*, but with the switching valve 338 being actuated by an actuator represented by box 500. Actuator 500 may be, but is not limited to, oil pressure (as in the embodiments presented above), a centrifugal valve, a pump, an on/off solenoid valve, electromagnetic, differential pressure control system (DPCS) or other such similar device. The switching of the switching valve 115 from a first position to a second position may also be related to speed or other engine parameters.

Figure 6A:
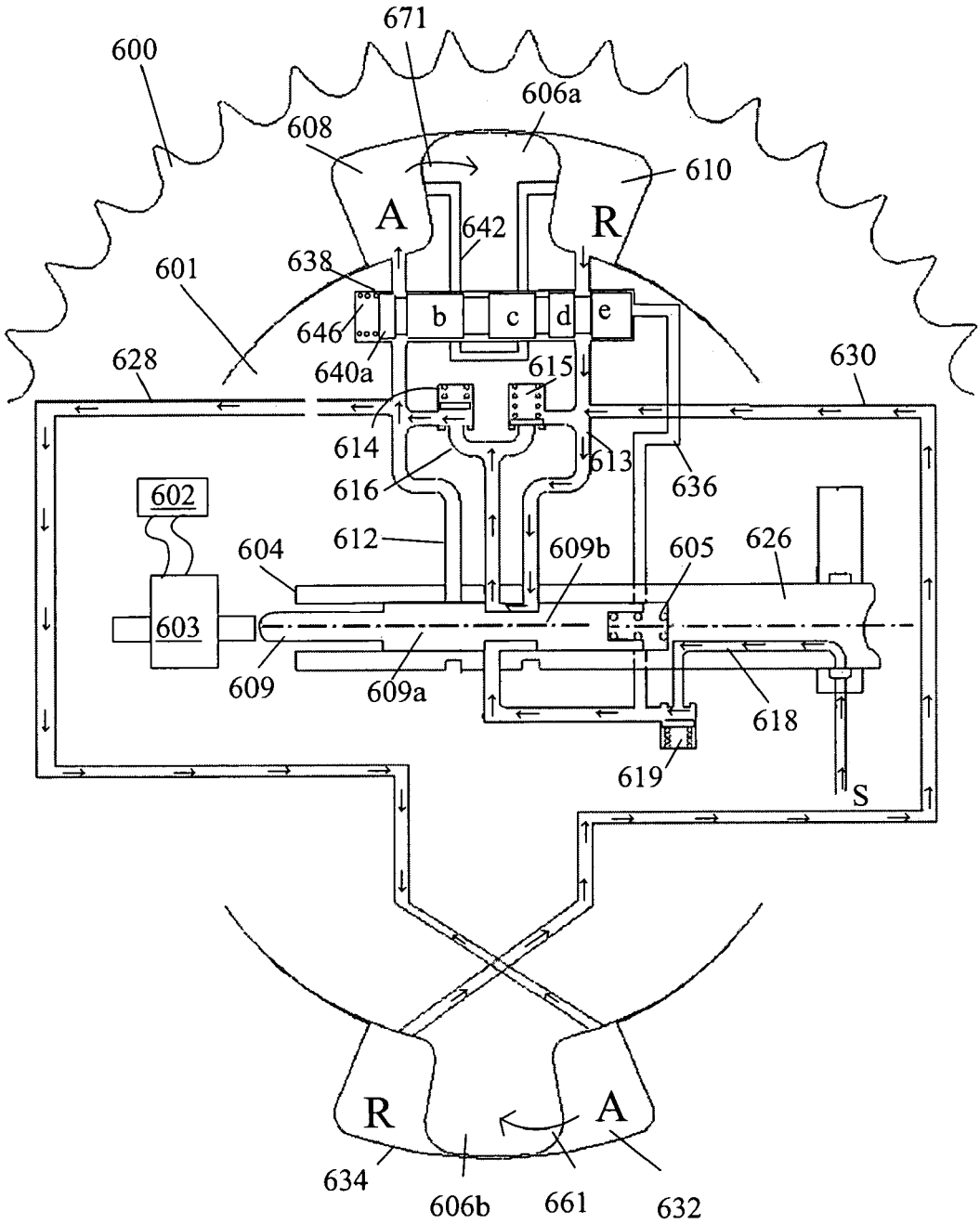
FIG. 6*a* shows a schematic of a cam torque actuated (CTA) phaser of the fourth embodiment with the phaser shifting to an advance position with an alternate switching valve flipped in a first position.
Figure 6B:
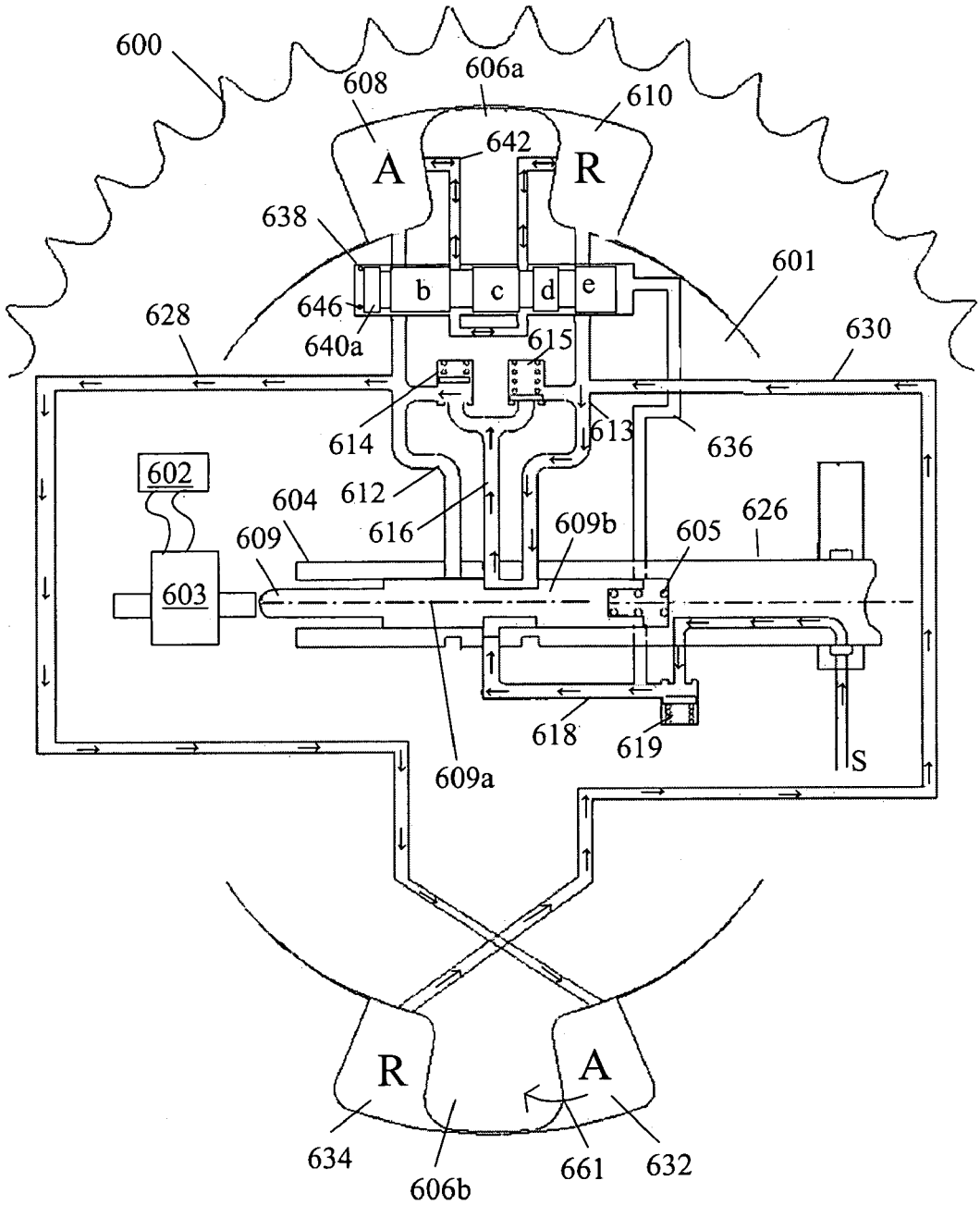
FIG. 6*b* shows a schematic of a cam torque actuated (CTA) phaser of the fourth embodiment with the phaser shifting to an advance position with an alternate switching valve flipped in a second position.

FIG. 6*a* shows a schematic of the phaser of the fourth embodiment with the phaser moving towards the advance position and with the switching valve having a spool with shortened and lengthened lands in comparison to FIG. 2*b* and in the first position. FIG. 6*b* shows a schematic of the phaser of the fourth embodiment with the phaser moving towards the advance position and with the switching valve in the second position.

The housing 600 of the phaser has an outer circumference for accepting drive force. The rotor 601 is connected to the camshaft 626 and is coaxially located within the housing 600. The rotor 601 has a first vane 606*a*, and a second vane 606*b*, with the first vane 606*a* separating a first chamber formed between the housing 600 and the rotor 601 into the first advance chamber 608 and the first retard chamber 610, and the second vane 606*b*, separating a second chamber formed between the housing 600 and the rotor 601 into the second advance chamber 632 and the second retard chamber 634. The first advance chamber 608 is connected to the first retard chamber 610 by a passage 642. The switching valve 638 controls whether fluid is allowed into the first advance and retard chamber 608, 610 from line 612, 613 and whether passage 642 is open between the first advance and retard chambers 608, 610 allowing direct communication between the chambers. The switching valve 638 is housed in a bore in the rotor 601 and has a spool 640 with a plurality of cylindrical lands 640*a*, 640*b*, 640*c*, 640*d*, 640*e*. The spool 640 is biased by spring 646. The first and the second vane 606*a* and 606*b* are capable of rotation to shift the relative angular position of the housing 600 and the rotor 601.

The phase control valve, preferably a spool valve 604 includes a spool 609 with cylindrical lands 609*a* and 609*b* slidably received in a bore of the rotor 601. The position of the spool 609 is influenced by spring 605 and a variable force solenoid (VFS) 603 controlled by the ECU 602.

The switching valve is in the first position, as shown in FIG. 6*a*, and the total volume of the phaser is four chambers. When the switching valve is in first position, the pressure of the fluid from the supply line 618 and 636 is not high enough to push on the end of the spool 640 of the switching valve 638, against the force of the spring 646, and therefore, the spool 640 of the switching valve is in a position in which spool lands 640*b* and 640*c* block passage 442 between the first advance chamber 608 and the first retard chamber 610.

In moving towards the advance position, the force of the variable force solenoid (VFS) 603 was increased and the spool 609 was moved to the right in the figure by the VFS 603, until the force of the spring 605 balances the force of the VFS 603. In the position shown, the spool 609 blocks line 612 with spool land 609*a*, lines 613 and 616 are open and the vanes 606*a*, 606*b* can move towards the advance position. Camshaft torque pressurizes the first retard chamber 610 and the second retard chamber 634, causing fluid in the first retard chamber 610 to move into the first advance chamber 608 and fluid in the second retard chamber 634 to move into the second advance chamber 632 and vanes 606*a* and 606*b* to move in the directions indicated by arrows 671, 661. Fluid exits form the first retard chamber 610 through line 613 and switching valve 638 between spool lands 640*d* and 640*e* to the spool valve 604 between spool lands 609*a* and 609*b* and recirculates back to central line 616 and the first advance chamber 608. Fluid also exits from the second retard chamber 634 through line 630 to line 613 and the spool valve 604 between spool lands 604*a* and 604*b* and recirculates back to central line 616 and the second advance chamber 632. Fluid is prevented from directly recirculating between the first advance chamber 608 and the first retard chamber 610 by blocking passage 642 with lands 640*b* and 640*c* of the switching valve 638. The word "directly" meaning allowing for fluid communication between the chambers without any intervening structures or valve to prevent bidirectional flow.

Since fluid from the central line 616 and the second advance chamber 632 and second retard chamber 634 can reach the first advance chamber 608 and the first retard chamber 610, the chambers 608, 610 are activated or switched into use and the total active volume of the chambers of the phaser includes all of the chambers 608, 610, 632, 634. The vanes 606*a*, 606*b*, separating the activated chambers 608, 610, 632, 634 are active.

Makeup oil is supplied to the phaser from supply to makeup for leakage and enters line 618 and moves through inlet check valve 619 to the spool valve 604. From the spool valve fluid enters line 616 through either of the check valves 614, 615, depending on which is open, either the first advance chamber 608, the first retard chamber 610, the second advance chamber 632, or the second retard chamber 634.

FIG. 6*b* shows the cam torque actuated phaser moving towards the advance position and the switching valve in the second position. When the switching valve is in the second position, the total active volume of the phaser decreases from four chambers to two chambers. The switching valve is moved from a first position to a second position when the pressure of the fluid in line 636 is greater than the force of the spring 646. Fluid is prevented from entering the first advance chamber 608 and the first retard chamber 610 by the switching valve 638. In this position, any fluid flow through line 612 to the first advance chamber 608 is blocked by spool land 640*b* of the switching valve 638 and any fluid flow through line 613 to the first retard chamber 610 is blocked by spool land 640*e* of the switching valve 638. Any fluid that is present in the first advance chamber 608 or the first retard chamber 610 recirculates directly between the chambers by passages 642. The word "directly" meaning allowing for fluid communication between the chambers without any intervening structures or valve to prevent bidirectional fluid flow. Direct recirculation of fluid moves through passage 642 and switching valve 638 between lands 640*b* and 640*c*, and 640*c* and 640*d*. Since fluid from the central line 616 and the second advance 632 and second retard chamber 634 cannot reach the first advance chamber 608 or the first retard chamber 610, the chambers 608, 610 are deactivated or switched out of use and the total active volume of the chambers of the phaser is limited to the active volume of the second advance chamber 632 and the active volume of the second retard chamber 634. The vane 606*a* separating the deactivated chambers 608, 610 is inactive. The vane 606*b* separating the active chambers 632, 634 is active.

Makeup oil is supplied to the phaser from supply to makeup for leakage and enters line 618 and moves through inlet check valve 619 to the spool valve 604. From the spool valve fluid enters line 616 through either of the check valves 614, 615, depending on which is open, either the second advance chamber 632 or the second retard chamber 634.

The increasing pressure of fluid to the switching valve in the above embodiment is preferably related to engine oil pressure. Alternatively, the increasing pressure may be related to the ECU in which an additional regulator valve would be present to increase the amount of pressure.

Figure 7A:
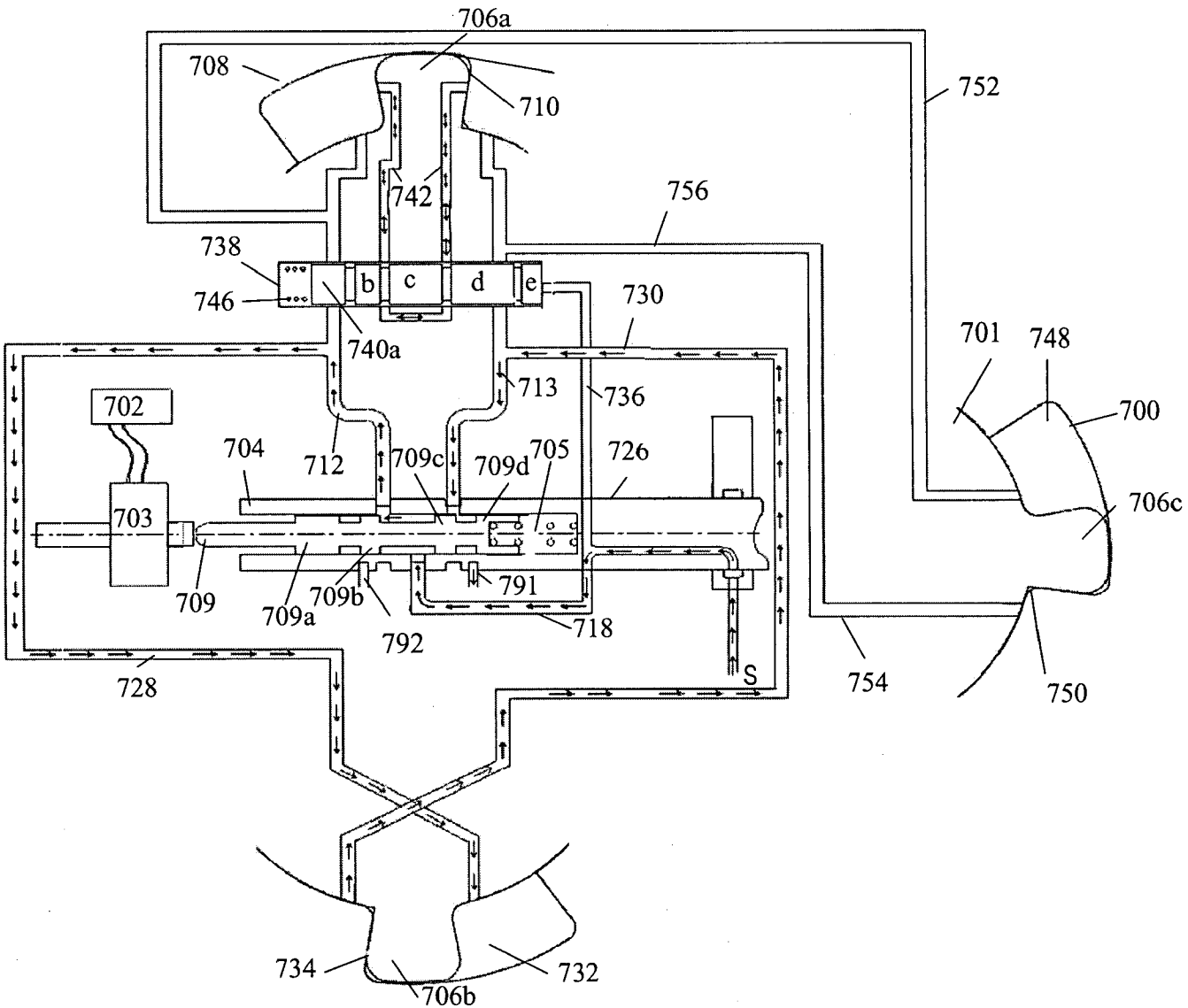
FIG. 7*a* shows a schematic of an oil pressure actuated phaser (OPA) of a fifth embodiment, with the phaser in an advance position and with the switching valve in a first position.
Figure 7B:
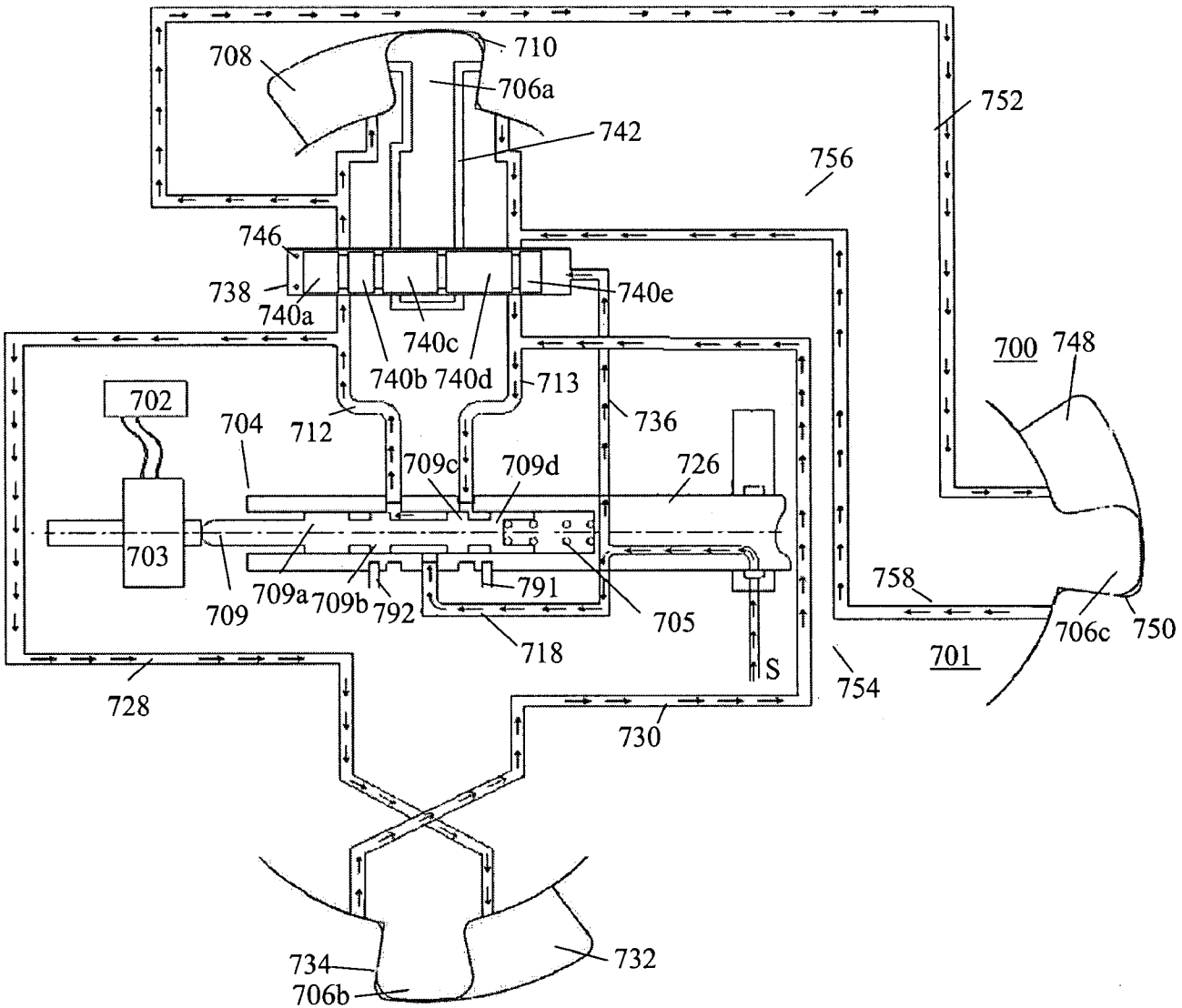
FIG. 7*b* shows a schematic of an oil pressure actuated phaser (OPA) of a fifth embodiment, with the phaser in an advance position and with the switching valve in a second position.

FIG. 7*a* shows an oil pressure actuated (OPA) phaser in the advance position with the switching valve in the first position. FIG. 7*b* shows the oil pressure actuated (OPA) phaser in the advance position with the switching valve in the second position.

The housing 700 of the phaser has an outer circumference for accepting drive force. The rotor 701 is connected to the camshaft 726 and is coaxially located within the housing 700. The rotor 701 has a first vane 706*a*, a second vane 706*b*, and a third vane 706*c*, with the first vane 706*a* separating a first chamber formed between the housing 700 and the rotor 701 into the first advance chamber 708 and the first retard chamber 710, the second vane 706*b* separating a second chamber into the second advance chamber 732 and the second retard chamber 734, and a third vane 706*c* separating a third chamber into the third advance chamber 748 and the third retard chamber 750. The first advance chamber 708 is directly connected to the first retard chamber 710 by passage 742. The first advance and retard chambers 708, 710 are connected to the third advance and retard chambers 748, 750 for direct recirculation of fluid through lines 752 and 754, respectively. A switching valve 738 controls the opening and closing of passage 742 and whether fluid is allowed into the first advance and retard chambers 708, 710 and subsequently the third advance and retard chambers 748, 750 from lines 712, 713, and lines 752 and 754, allowing direct fluid communication between them. The switching valve 738 is housed in a bore in the rotor 701 and has a spool 740 with a plurality of cylindrical lands 740*a*, 740*b*, 740*c*, 740*d*, and 740*e*. The spool 740 is biased by spring 746. The first, second, and third vanes 706*a*, 706*b*, 706*c* are capable of rotation to shift the relative angular position of the housing 700 and the rotor 701.

A phase control valve, preferably a spool valve 704 includes a spool 709 with cylindrical lands 709*a*, 709*b*, 709*c*, and 709*d* is slidably received in a bore in the rotor 701. The position of the spool 709 is influenced by spring 705 and a variable force solenoid (VFS) 703 controlled by the ECU 702. The position of the spool 709 controls the motion (e.g. to move towards the advance position or the retard position) of the phaser.

As shown in FIG. 7*a*, the oil pressure actuated phaser is in the advance position. To move towards this position, the force of the variable force solenoid 703 was increased and the spool 709 was moved to the right by VFS 703, until the force of the spring 705 balances the force of the VFS 703. In the position shown line 712 is open for receiving fluid from line 718 and line 713 is open to allow fluid to drain through the spool valve 704 and exhaust line 791, moving the vane to an advance position. Exhaust line 792 is blocked by spool land 709*b*.

Fluid enters the phaser through supply line 718 and flows into the spool valve 704. From spool valve 704, fluid moves into line 712 and then into line 728, leading to the second advance chamber 732. The fluid in the second advance chamber 732 causes the second vane 706*b* to move to the advanced position shown, causing fluid in the second retard chamber 734 to exit the chamber through line 730. From line 730, fluid enters line 713 and the spool valve 704 between spool lands 709*c* and 709*d* and exits the phaser through exhaust line 791.

Fluid is prevented from entering the first advance chamber 708, the first retard chamber 710, the third advance chamber 748, or the third retard chamber 750 by switching valve 738. The spool 740 of the switching valve 738 is biased to a first position in which the force of the spring 746 is greater than the pressure of the fluid available from line 736. In this position, any fluid flow through line 712 to the first advance chamber 708 and the third advance chamber 748 is blocked by spool land 740*a* of the switching valve 738 and any fluid flow through line 713 to the first retard chamber 710 and the third retard chamber 750 is blocked by spool land 740*d* of the switching valve 738. Any fluid that is present in the first advance chamber 708, the first retard chamber 710, the third advance chamber 748, and the third retard chamber 750 recirculates directly between the chambers by passages, 742, 752, and 754. The word "directly" meaning allowing for fluid communication between the chambers without any intervening structures or valve to prevent bidirectional fluid flow. Direct circulation of fluid between the first advance chamber 708 and the first retard chamber 710 occurs through passage 742 and switching valve 738 between lands 740*b* and 740*c*, and 740*c* and 740*d*. Direct circulation of fluid between the first advance chamber 708 and the third advance chamber 748 is through line 752 and direct circulation of fluid between the first retard chamber 710 and the third retard chamber 750 is through line 754.

Since fluid from the second advance 732 and second retard chambers 734 cannot reach the first advance chamber 708, the first retard chamber 710, the third advance chamber 748, or the third retard chamber 750, the chambers 708, 710, 748, 750 are deactivated or switched out of use and the total volume of the chambers of the phaser is limited to the volume of the second advance chamber 732 and the volume of the second retard chamber 734. The vane 706*a* separating the deactivated chambers 708, 710 and the vane 706*c* separating deactivated chambers 748, 750 is inactive. The vane 706*b* separating the active chambers 732, 734 is active.

FIG. 7*b* shows the oil pressure actuated (OPA) phaser in the advance position and the switching valve in the second position. When the switching valve is in the second position, the total volume of the phaser increases from two chambers to six chambers. The switching valve is moved from a first position to a second position when the pressure of the fluid in line 736 is high enough to push on the end of the spool 740 of the switching valve 738, against the force of the spring 746, moving the spool 740 inward and to a second position, with passage 742 being blocked by lands 740*c* and 740*d*.

When the phaser is in the advance position, the force of the of the spring 705 of the spool valve 704 is greater than the force of the variable force solenoid 703, and the spool 709 is moved to an inner position by the VFS 703, such that line 712 is open for receiving fluid from line 718 and line 713 is open to allow fluid to drain through the spool 709 and exhaust line 791, moving the vanes 706*a*, 706*b*, 706*c* to an advance position. Exhaust line 792 is blocked by spool land 709*b*.

Fluid enters the phaser through supply line 718 and flows into spool valve 704. From spool valve 704, fluid moves into line 712, leading to the first advance chamber 708, and line 728, leading to the second advance chamber 732. From line 712, fluid passes through the switching valve 738 between lands 740*a* and 740*b* to the first advance chamber 708 and line 752 leading to the third advance chamber 748. The fluid in the first advance chamber 708, causes the first vane 706*a* to move to the advance position shown, causing fluid in the first retard chamber 710 to exit the chamber and move through the switching valve 738 between lands 740*d* and 740*e* to line 713. From line 713, fluid enters the spool valve 704 between spool lands 709*e* and 709*e* and exits the phaser through exhaust line 791.

The fluid in the second advance chamber 732 from line 728 causes the second vane 706*b* to move to the advance position shown, causing fluid in the second retard chamber 734 to exit the chamber through line 730. From line 730, fluid enters line 713 and the spool valve 704 between spool lands 709*d* and 709*e* and exits the phaser through exhaust line 791.

Fluid is supplied to the third advance chamber 748 by line 752, which receives fluid from line 712 between the first advance chamber 708 and the switching valve 738. Fluid in the third advance chamber 748 causes the third vane 706*c* to move to the advance position as shown, causing fluid in the third retard chamber 750 to exit the chamber through line 754 leading to line 713 in between the first retard chamber 710 and the switching valve 738. From line 713, fluid moves through the switching valve 738 between lands 740*d* and 740*e* to the spool valve 704 between spool lands 709*d* and 709*e* and exits the phaser through exhaust line 791.

Since fluid from the second advance chamber 732 and second retard chamber 734 can reach the first advance chamber 708, the first retard chamber 710, the third advance chamber 748, and the third retard chamber 750, the chambers 708, 710, 748, 750 are activated or switched into use and the total volume of the chambers of the phaser includes all of the chambers 708, 710, 732, 734, 748, 750. The vanes 706*a*, 706*b*, 706*c* separating the activated chambers 708, 710, 732, 734, 748, 750 are active.

Figure 8A:
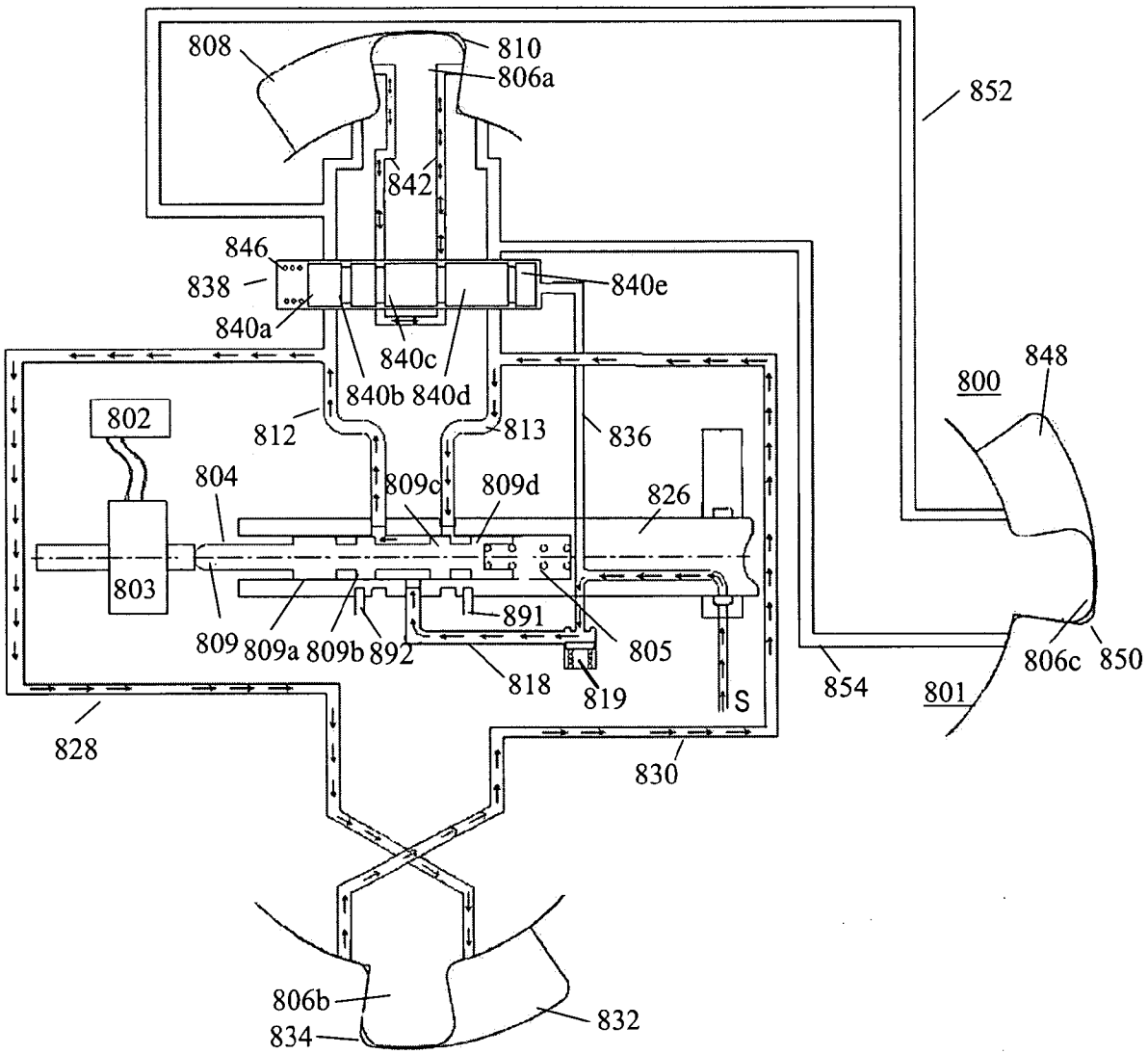
FIG. 8*a* shows a schematic of a torsion assist phaser (TA) of a sixth embodiment, with the phaser in the advanced position and with the switching valve in a first position.

FIG. 8*a* shows a torsion assist (TA) phaser in the advance position with the switching valve in the first position. FIG. 7*b* shows the torsion assist (TA) phaser in the advance position with the switching valve in the second position.

The housing 800 of the phaser has an outer circumference for accepting drive force. The rotor 801 is connected to the camshaft 826 and is coaxially located within the housing 800. The rotor 801 has a first vane 806*a*, a second vane 806*b*, and a third vane 806*c*, with the first vane 806*a* separating a first chamber formed between the housing 800 and the rotor 801 into the first advance chamber 808 and the first retard chamber 810, the second vane 806*b* separating a second chamber into the second advance chamber 832 and the second retard chamber 834, and a third vane 806*c* separating a third chamber into the third advance chamber 848 and the third retard chamber 850. The first advance chamber 808 is directly connected to the first retard chamber 810 by passage 842. The first advance and retard chambers 808, 810 are connected to the third advance and retard chambers 848, 850 for direct recirculation of fluid through lines 852 and 854, which branch off from lines 812 and 813 respectively. A switching valve 838 controls the opening and closing of passage 842 and whether fluid is allowed into the first advance and retard chambers 808, 810 and subsequently the third advance and retard chambers 848, 850 from lines 812, 813, and lines 852, and 854, allowing direct fluid communication between them. The switching valve 838 is housed in a bore in the rotor 801 and has a spool 840 with a plurality of cylindrical lands 840*a*, 840*b*, 840*c*, 840*d*, and 840*e*. The spool 840 is biased by spring 846. The first, second, and third vanes 806*a*, 806*b*, 806*c* are capable of rotation to shift the relative angular position of the housing 800 and the rotor 801.

A phase control valve, preferably a spool valve 804 includes a spool 809 with cylindrical lands 809*a*, 809*b*, 809*c*, and 809*d* slidably received in a bore in the rotor 801. The position of the spool 809 is influenced by spring 805 and a variable force solenoid (VFS) 803 controlled by the ECU 802.

As shown in FIG. 8*a*, the torsion assist phaser is in the advance position. In this position, the force of the of the spring 805 of the spool valve 804 is greater than the force of the variable force solenoid 803, and the spool 809 is moved to an inner position, such that line 812 is open for receiving fluid from line 818 and line 813 is open to allow fluid to drain through the spool 809 and exhaust line 890, moving the vane to an advance position. Exhaust line 892 is blocked by spool land 809*b*.

Fluid enters the phaser through supply line 818 and inlet check valve 819 and flows into the spool valve 804. The inlet check valve 819 eliminates fluid from flowing back through to the source during a torque reversal. From spool valve 804, fluid moves into line 812 and then into line 828, leading to the second advance chamber 832. The fluid in the second advance chamber 832 causes the second vane 806*b* to move to the advanced position shown, causing fluid in the second retard chamber 834 to exit the chamber through line 830. From line 830, fluid enters line 813 and the spool valve 804 between spool lands 809*c* and 809*d* and exits the phaser through exhaust line 891.

Fluid is prevented from entering the first advance chamber 808, the first retard chamber 810, the third advance chamber 848, or the third retard chamber 850 by switching valve 838. The spool 840 of the switching valve 838 is biased to a first position in which the force of the spring 846 is greater than the pressure of the fluid available in line 836. In this position, any fluid flow through line 812 to the first advance chamber 808 and the third advance chamber 848 is blocked by spool land 840*a* of the switching valve 838 and any fluid flow through line 813 to the first retard chamber 810 and the third retard chamber 850 is blocked by spool land 840*d* of the switching valve 838. Any fluid that is present in the first advance chamber 808, the first retard chamber 810, the third advance chamber 848, and the third retard chamber 850 recirculates directly between the chambers by passages, 842, 852, and 854. The word "directly" meaning allowing for fluid communication between the chambers without any intervening structures or valve to prevent bidirectional fluid flow. Direct recirculation of fluid moves through passage 842 and switching valve 838 between lands 840*b* and 840*c*, and 840*c* and 840*d*.

Since fluid from the second advance 832 and second retard chambers 834 cannot reach the first advance chamber 808, the first retard chamber 810, the third advance chamber 848, or the third retard chamber 850, the chambers 808, 810, 848, 850 are deactivated or switched out of use and the total volume of the chambers of the phaser is limited to the volume of the second advance chamber 832 and the volume of the second retard chamber 834. The vane 806*a* separating the deactivated chambers 808, 810 and the vane 806*c* separating deactivated chambers 848, 850 is inactive. The vane 806*b* separating the active chambers 832, 834 is active.

Figure 8B:
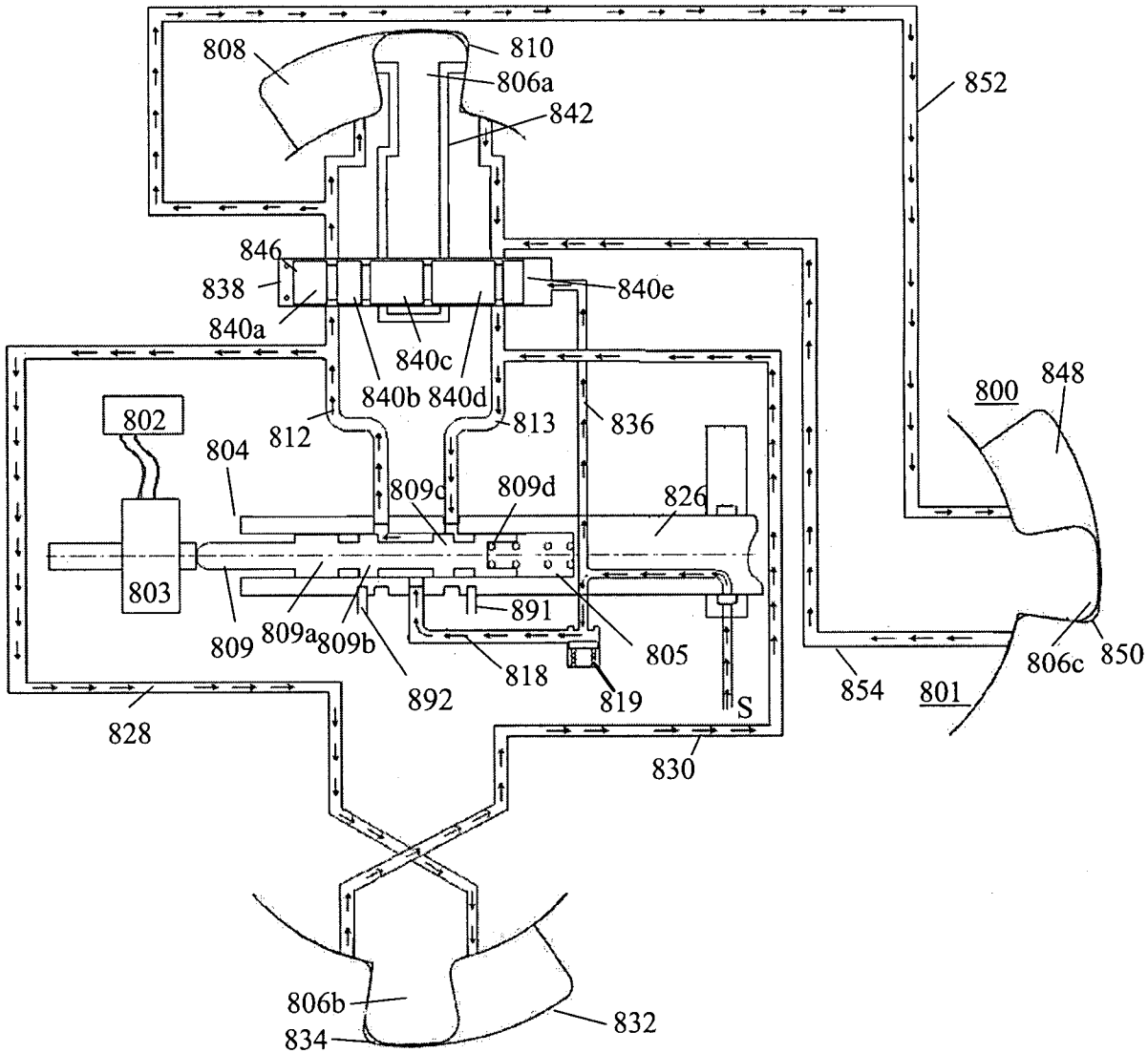
FIG. 8*b* shows a schematic of a torsion assist phaser (TA) of a sixth embodiment, with the phaser in the advanced position and with the switching valve in a second position.

FIG. 8*b* shows the torsion assist phaser in the advance position and the switching valve in the second position. When the switching valve is in the second position, the total volume of the phaser increases from two chambers to six chambers. The switching valve is moved from a first position to a second position when the pressure of the fluid in line 836 is high enough to push on the end of the spool 840 of the switching valve 838, against the force of the spring 846, moving the spool 840 inward and to a second position, with passage 842 being blocked by lands 840*c* and 840*d*.

When the phaser is in the advance position, the force of the of the spring 805 of the spool valve 804 is greater than the force of the variable force solenoid 803, and the spool 809 is moved to an inner position, such that line 812 is open for receiving fluid from line 818 and line 813 is open to allow fluid to drain through the spool 809 and exhaust line 890, moving the vanes 806*a*, 806*b*, 806*c* to an advance position. Exhaust line 892 is blocked by spool land 809*b*.

Fluid enters the phaser through supply line 818 and inlet check valve 819 and flows into spool valve 804. The inlet check valve 819 eliminates fluid from flowing back through to the source during a torque reversal. From spool valve 804, fluid moves into line 812, leading to the first advance chamber 808, and line 828, leading to the second advance chamber 832. From line 812, fluid passes through the switching valve 838 between lands 840*a* and 840*b* to the first advance chamber 808 and line 852 leading to the third advance chamber 848. The fluid in the first advance chamber 808, causes the first vane 806*a* to move to the advance position shown, causing fluid in the first retard chamber 810 to exit the chamber and move through the switching valve 838 between lands 840*d* and 840*e* to line 813. From line 813, fluid enters the spool valve 804 between spool lands 809*e* and 809*e* and exits the phaser through exhaust line 891.

The fluid in the second advance chamber 832 from line 828 causes the second vane 806*b* to move to the advance position shown, causing fluid in the second retard chamber 834 to exit the chamber through line 830. From line 830, fluid enters line 813 and the spool valve 804 between spool lands 809*d* and 809*e* and exits the phaser through exhaust line 891.

Fluid is supplied to the third advance chamber 848 by line 852, which receives fluid from line 812 between the first advance chamber 808 and the switching valve 838. Fluid in the third advance chamber 848 causes the third vane 806*c* to move to the advance position shown, causing fluid in the third retard chamber 850 to exit the chamber through line 854 leading to line 813 in between the first retard chamber 810 and the switching valve 838. From line 813, fluid moves through the switching valve 838 between lands 840*d* and 840*e* to the spool valve 804 between spool lands 809*d* and 809*e* and exits the phaser through exhaust line 891.

Since fluid from the second advance chamber 832 and second retard chamber 834 can reach the first advance chamber 808, the first retard chamber 810, the third advance chamber 848, and the third retard chamber 850, the chambers 808, 810, 848, 850 are activated or switched into use and the total volume of the chambers of the phaser includes all of the chambers 808, 810, 832, 834, 848, 850. The vanes 806*a*, 806*b*, 806*c* separating the activated chambers 808, 810, 832, 834, 848, 850 are active.

Figure 9A:
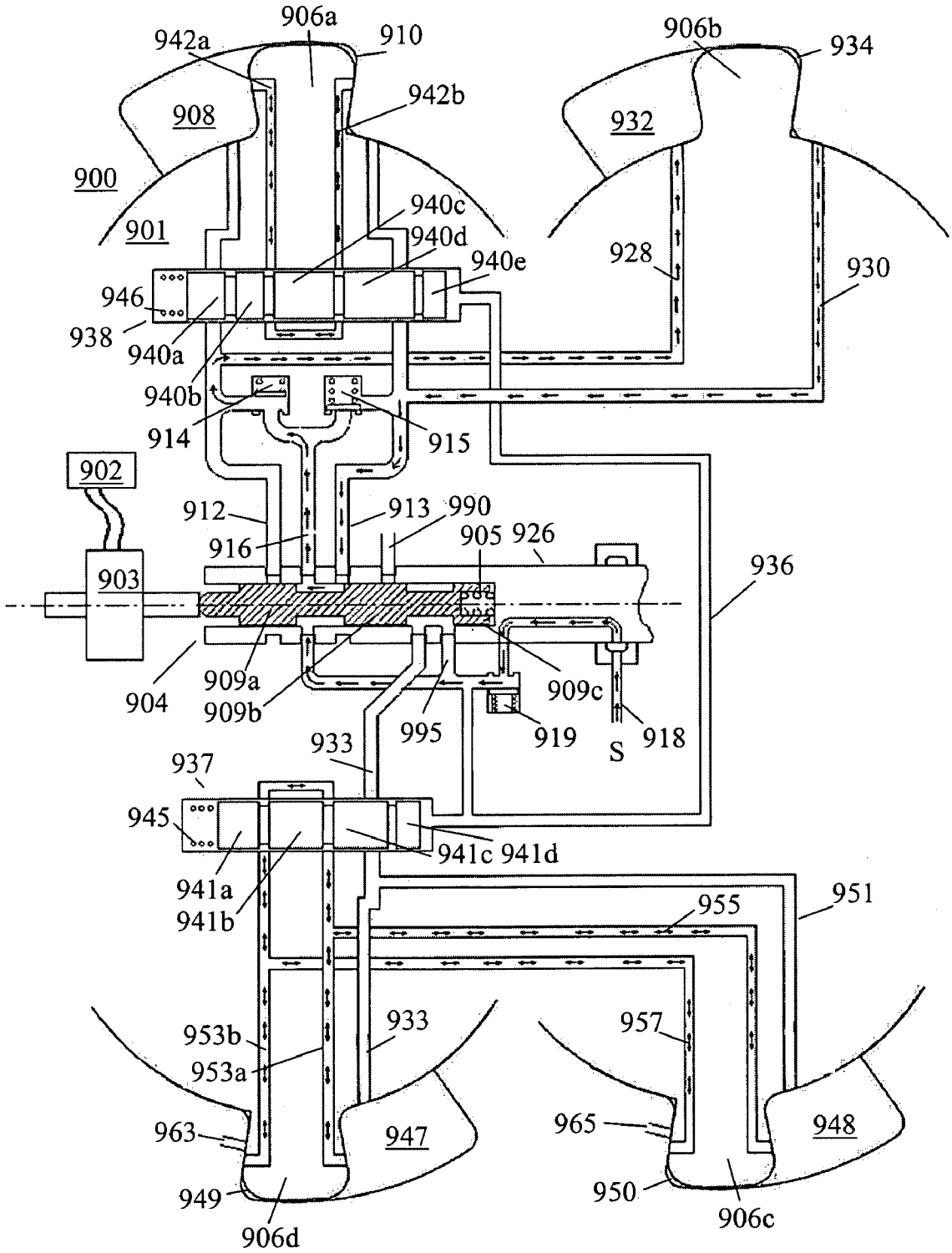
FIG. 9*a* shows a schematic of a hybrid phaser of a seventh embodiment, with the phaser in the advanced position and with the switching valves in a first position.
Figure 9B:
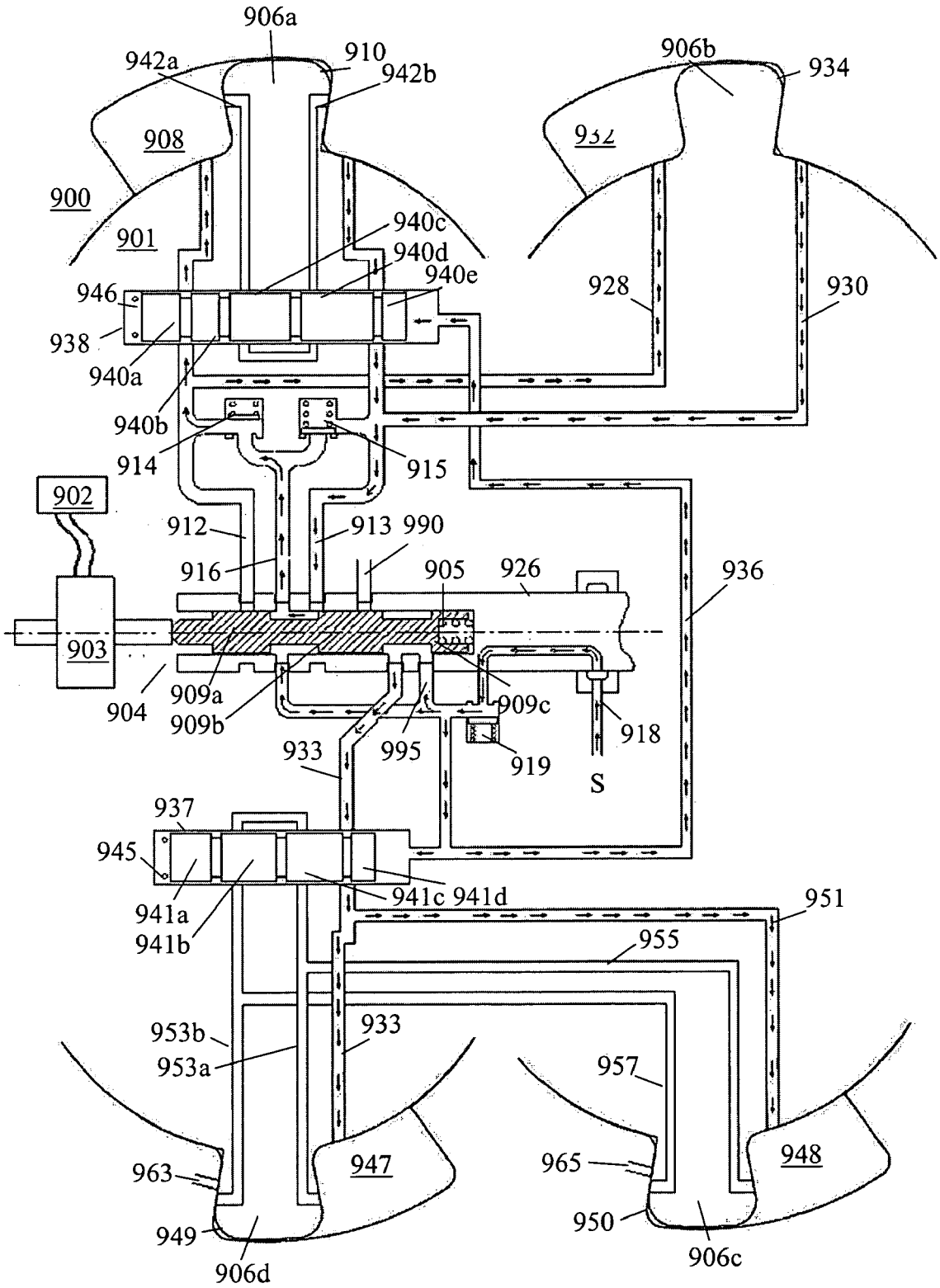
FIG. 9*b* shows a schematic of a hybrid phaser of a seventh embodiment, with the phaser in the advanced position and with the switching valves in a second position.

FIG. 9*a* shows a hybrid phaser in the advance position with the switching valve in the first position. FIG. 9*b* shows the hybrid phaser in the advance position with the switching valve in the second position. The hybrid phaser shown has four vanes that would normally be spaced 90 degrees apart from each other, but are arranged next to each other in the figures for simplicity. Furthermore, while two switching valves are shown, but only one may also be used.

Some cam torque actuated phasers have a low actuation rate at high speeds. However, oil pressure actuated (OPA) and torsion assist (TA) phasers have a high actuation rate at high speeds. By using a phaser with both CTA and OPA or TA portions, the phaser has a high actuation rate at both high and low speeds, resulting in satisfactory engine performance.

The housing 900 of the phaser has an outer circumference for accepting drive force. The rotor 901 is connected to the camshaft 926 and is coaxially located within the housing 900. The rotor 901 has a first vane 906*a*, a second vane 906*b*, a third vane 906*c*, and a fourth vane 906*b* with the first vane 906*a* separating a first chamber formed between the housing 900 and the rotor 901 into the first advance chamber 908 and the first retard chamber 910, the second vane 906*b* separating a second chamber into the second advance chamber 932 and the second retard chamber 934, a third vane 906*c* separating a third chamber into the third advance chamber 948 and the third retard chamber 950, and a fourth vane 906*d* separating a fourth chamber into the fourth advance chamber 947 and the fourth retard chamber 949. The first advance chamber 908 is directly connected to the first retard chamber 910 by passage 942 and the fourth advance chamber 947 is directly connected to the fourth retard chamber 949 by passage 953. The fourth advance and retard chambers 947, 949 are connected to the third advance and retard chambers 948, 950 for direct recirculation of fluid through lines 955 and 957, which branch off from passage legs 953*a*, 953*b* respectively. The third retard chamber 950 and the fourth retard chamber 949 each contain an exhaust passage 965, 963 respectively. The first vane 906*a* and the second vane 906*b* are cam torque actuated (CTA). The third vane 906*c* and the fourth vane 906*d* are oil pressure actuated (OPA).

A first switching valve 938 controls the opening and closing of passage 942 and whether fluid is allowed into the first advance and retard chambers 908, 910 from lines 912, 913, allowing direct fluid communication between them. The switching valve 938 is housed in a bore in the rotor 901 and has a spool 940 with a plurality of cylindrical lands 940*a*, 940*b*, 940*c*, 940*d*, and 940*e*. The spool 940 is biased by spring 946. The first, second, third, and fourth vanes 906*a*, 906*b*, 906*c*, 906*d* are capable of rotation to shift the relative angular position of the housing 900 and the rotor 901.

A second switching valve controls the opening and closing of passage 953 and whether fluid is allowed into the fourth advance and retard chambers 947, 949 and subsequently the third advance and retard chambers 948, 950 for direct recirculation of fluid through lines 955, 957, which branch off from passage legs 953*a* and 953*b* respectively.

A phase control valve, preferably a spool valve 904 includes a spool 909 with cylindrical lands 909*a*, 909*b*, and 909*c* slidably received in a bore in the rotor 901. The position of the spool 909 is influenced by spring 905 and a variable force solenoid (VFS) 903 controlled by the ECU 902.

Torque reversals in the camshaft caused by the forces of opening and closing engine valves move the cam torque actuated (CTA) vanes 906*a*, 906*b*. The CTA advance and retard chambers 908, 910, 932, 934 are arranged to resist positive and negative torque pulses in the camshaft and are alternatively pressurized by the cam torque. The control valve or spool valve 904 allows the CTA vanes 906*a*, 906*b* in the phaser to move, by permitting fluid flow from the first advance chamber 908 or second advance chamber 932 to the first retard chamber 910 or the second retard chamber 910, 934 or vice versa, depending on the desired direction of movement. Positive cam torsionals are used to move the phaser towards the retard position. Negative cam torsionals move the phaser towards the advance position.

The other portion of the phaser is oil pressure actuated (OPA). Line 933 from the spool valve 909 provides fluid to the OPA fourth advance chamber 947. If the OPA vane 906*b* is moved, as shown in FIG. 9*a*, fluid in the OPA fourth retard chamber 949 exhausts or vents through line 963 to sump. Line 951 branches off of line 933 and provides fluid to the OPA third advance chamber 948. If the OPA vane 906*b* is moved, as shown in FIG. 9*a*, fluid in the OPA third retard chamber 950 exhausts or vents through line 965 to sump.

As shown in FIG. 9*a*, the hybrid phaser is in the advance position and the first and second switching valves are in the first position. When the switching valves are in the first position, the total volume of the phaser is the active volume present in the second advance chamber 932 and the second retard chamber 934. The switching valves 938, 937 are in the first position when the pressure of the fluid in lines 936 is not high enough to push on the end of the spools 940, 941 of the switching valves 938, 937, against the force of the springs 946, 945. With the switching valves in the first position, passages 942 and 953 are open and lines 912, 913 and 933 are blocked by spool lands 940*a*, 940*d*, and 941*c* respectively.

In this position, the force of the variable force solenoid (VFS) 903 was increased and the spool 909 was moved to the right in the figure, until the force of the spring 905 balances the force of the VFS 903. In the position shown, the spool 909 blocks line 912 with spool land 909*a* and exhaust line 913 with spool land 909*b*, lines 913, 916, 933, 995 are open and the vanes 906*a*, 906*b* can move towards the advance position. Camshaft torque pressurizes the second CTA retard chamber 934, causing fluid in the second CTA retard chamber 934 to move into the second advance chamber 932 and vane 906*b* to move. Fluid exits from the second retard chamber 934 through line 930 to line 913 and the spool valve 904 between spool lands 904*a* and 904*b* and recirculates back to central line 916 and the second advance chamber 932.

Fluid is prevented from entering the first advance chamber 908 and the first retard chamber 910 by the first switching valve 938. The spool 940 of the switching valve 938 is biased to a first position in which the force of the spring 946 is greater than the pressure of fluid available from line 936. In this position, any fluid flow through line 912 to the first advance chamber 908 is blocked by spool land 940*a* of the switching valve 938 and any fluid flow through line 913 to the first retard chamber 910 is blocked by spool land 940*d* of the first switching valve 938. Any fluid that is present in the first advance 908 and the retard chambers 910 recirculates directly between the chambers through passage 942 and between switching valve lands 940*b*, 940*c*, and 940*c* and 940*d*. The word "directly" meaning allowing for fluid communication between the chambers without any intervening structures or valve to prevent bidirectional fluid flow. Fluid is also prevented from entering the third OPA advance chamber 948 and the fourth OPA advance chamber 947 by the second switching valve 937. The spool 941 of the second switching valve 937 is biased to a first position in which the force of the spring 945 is greater than the pressure of fluid available from line 936. In this position, any fluid flow through line 933 to the fourth advance chamber 947 and subsequently the third advance chamber 948 is blocked by spool land 941*c* of the second switching valve 937.

Since fluid from the central line 916, the second CTA advance chamber 932, and the second CTA retard chamber 934 cannot reach the first CTA advance chamber 908, the first CTA retard chamber 910, the third OPA advance chamber 948, and the fourth OPA advance chamber 947, the chambers 908, 910, 948, 947, 949, 950 are deactivated or switched out of use and the total active volume of the chambers of the phaser is limited to the active volume of the second CTA advance chamber 932 and the active volume of the second CTA retard chamber 934. The vane 906*a* separating the deactivated chambers 908, 910, the vane 906*c* separating deactivated chambers 948, 950, and vane 906*d* separating deactivated chambers 947, 949 are inactive. The vane 906*b* separating the active chambers 932, 934 is active.

Makeup fluid is supplied to the phaser from supply to makeup for leakage and enters line 918 and moves through inlet check valve 919 to the spool valve 904. From the spool valve fluid enters line 916 through either of the check valves 914, 915, depending on which is open, either the second advance chamber 932 or the second retard chamber 934.

FIG. 9*b* shows the hybrid phaser in the advance position and the switching valve in the second position. When the switching valves are in the second position, the total volume of the phaser increases from two chambers to six chambers. The switching valves 938, 937 are moved from a first position to a second position when the pressure of the fluid in line 936 is high enough to push on the end of the spools 940, 941 of the switching valves 938, 937, against the force of the springs 946, 945 moving the spools 940,941 inward and to a second position, with passages 942, 953 being blocked by lands 940*c* and 940*d* and 941*b* and 941*c* respectively.

In this position, the force of the variable force solenoid (VFS) 903 was increased and the spool 909 was moved to the right in the figure, until the force of the spring 905 balances the force of the VFS 903. In the position shown, the spool 909 blocks line 912 with spool land 909*a* and exhaust line 913 with spool land 909*b*, lines 913, 916, 933, 995 are open and the vanes 906*a*, 906*b* can move towards the advance position. Camshaft torque pressurizes the first CTA retard chamber 910 and the second CTA retard chamber 934, causing fluid in the first CTA retard chamber 910 to move into the first CTA advance chamber 908 and fluid in the second CTA retard chamber 934 to move into the second CTA advance chamber 932 and vanes 906*a* and 906*b* to move. Fluid exits from the first CTA retard chamber 910 through line 913 and the first switching valve 938 between spool lands 940*d* and 940*e* to the spool valve 904 between spool lands 909*a* and 909*b* and recirculates back to central line 916 and the first advance chamber 908. Fluid also exits from the second retard chamber 934 through line 930 to line 913 and the spool valve 904 between spool lands 909*a* and 909*b* and recirculates back to central line 916 and the second advance chamber 932. Fluid is prevented from directly recirculating between the first advance chamber 908 and the first retard chamber 910 by blocking passage 942 with lands 940*c* and 940*d* of the switching valve 938. The word "directly" meaning allowing for fluid communication between the chambers without any intervening structures or valve to prevent bidirectional flow.

Makeup fluid is supplied to the phaser from supply to make up for leakage and enters line 918 and moves through inlet check valve 919 to the spool valve 904. From the spool valve 909, fluid enters line 916 and through either of the check valves 914, 915, depending which is open to the CTA first or second advance or retard chambers. The makeup fluid is also directed from line 918 to line 995, through spool valve 904 between spool lands 909*b* and 909*c* to line 933. Line 933 passes through the second switching valve 937 between spool lands 941*c* and 941*d* and supplies the OPA fourth advance chamber 947 and the third OPA advance chamber 947 through line 951. The fluid in the OPA third advance chamber 948 and the OPA fourth advance chamber 947 helps move the phaser to the advance position shown. Fluid in the OPA third retard chamber 950 is vented to sump through line 965 and the OPA fourth retard chamber is vented to sump through line 963.

Since fluid from the central line 916 and the second advance chamber 932 and second retard chamber 934 can reach the first advance chamber 908, the first retard chamber 910, the third advance chamber 948, and the fourth advance chamber 947, the chambers 908, 910, 948, 947, 949, 950 are activated or switched into use and the total volume of the chambers of the phaser includes all of the chambers 908, 910, 932, 934, 948, 947. The vanes 906*a*, 906*b*, 906*c*, 906*d* separating the activated chambers 908, 910, 932, 934, 948, 950, 947, 949 are active.

FIGS. 9*a* and 9*b* show the exhaust lines 963, 965 on the retard sides of the chambers and lines 933 and 951 with fluid leading to the fourth advance chamber 947 and the third advance chamber 948 respectively, however this maybe switched so that the exhaust lines 963, 965 would be located on the advance sides of the chambers and lines 933, 951 with fluid leading to the third and fourth retard chambers 949, 950.

While four vanes were shown in FIGS. 9*a* and 9*b*, only three vanes may used, eliminating the third vane chamber and lines 951, 955, and 957. The switching valve 937 would function as described above.

Figure 10A:
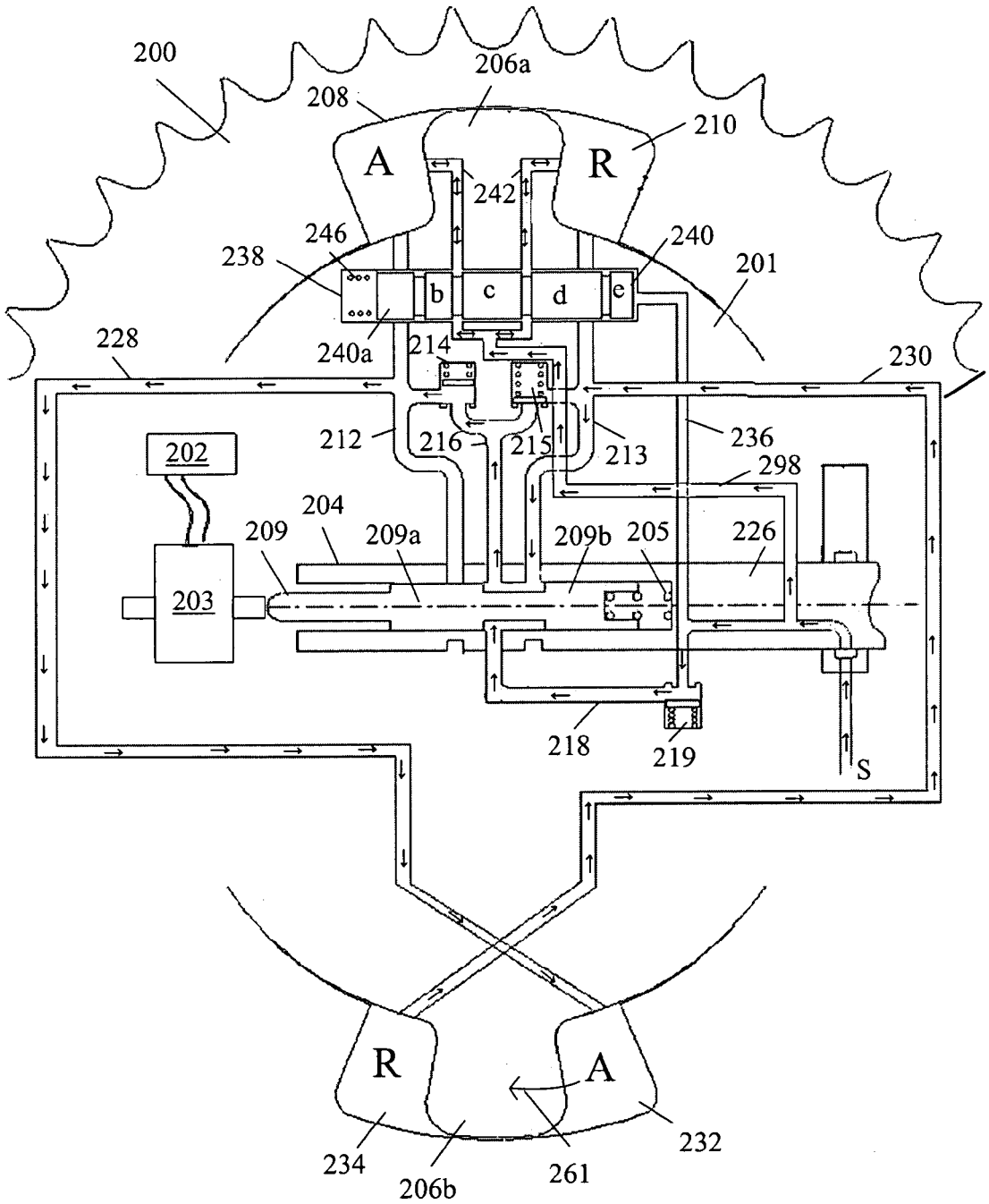
FIG. 10*a* shows a schematic of a cam torque actuated (CTA) phaser of an eighth embodiment, with the phaser shifting to the advance position and with a switching valve in a first position.
Figure 10B:
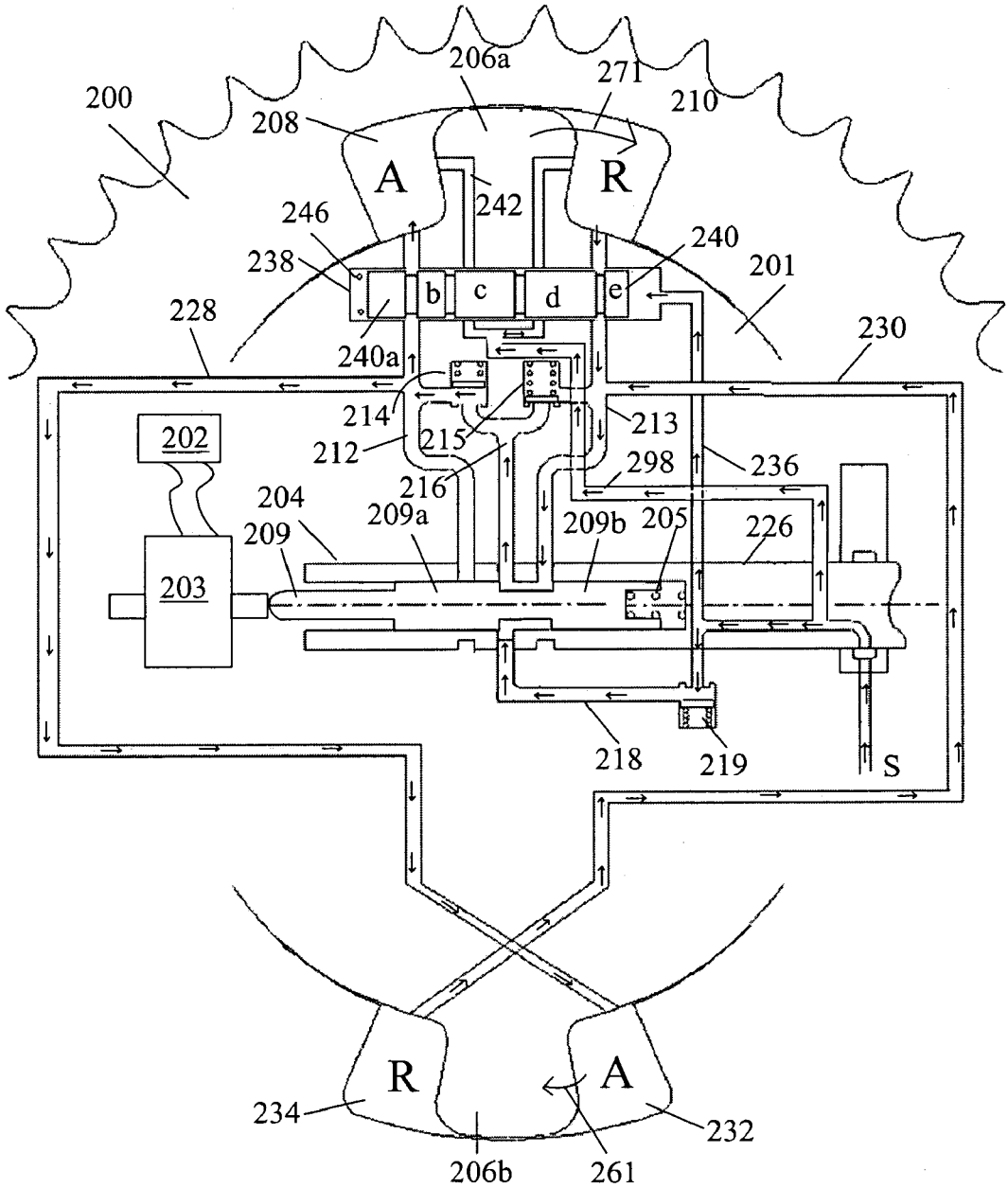
FIG. 10*b* shows a schematic of a cam torque actuated (CTA) phaser of an eighth embodiment, with the phaser shifting to the advance position and with a switching valve in a second position.

FIG. 10*a* shows an alternate embodiment of a cam torque actuated phaser moving towards the advance position with the switching valve in the first position. FIG. 10*b* shows an alternative embodiment of a cam torque actuated phaser moving towards the advance position with the switching valve in the second position. The phaser is similar to the phasers shown in FIGS. 2*a* through 2*d*, except for an additional supply line 298 that has been added between the supply line 218 before the inlet check valve 219 leading to a portion of passage 242 between the switching valve 240 and the phase control valve 204. As soon as switching valve lands 240*c* and 240*d* block passage 242 to the deactivated chambers 208, 210, fluid from line 298 is present to immediately fill or add additional fluid to the chambers 208, 210 to maintain the fluid level so that an immediate response is received. If additional fluid is not supplied to the deactivated chambers 206, 208, the chambers may eventually leak and become filled with air, causing a delay or loss of control of the phaser when the deactivated chambers become active again.

As described earlier, the housing 200 of the phaser has an outer circumference for accepting drive force. The rotor 201 is connected to the camshaft 226 and is coaxially located within the housing 200. The rotor 201 has a first vane 206*a*, and a second vane 206*b*, with the first vane 206*a* separating a first chamber formed between the housing 200 and the rotor 201 into the first advance chamber 208 and first retard chamber 210, and the second vane 206*b* separating a second chamber formed between the housing 200 and the rotor 201 into the second advance chamber 232 and the second retard chamber 234. The first advance chamber 208 is connected to the first retard chamber 210 by passage 242. A switching valve 238 controls whether fluid is allowed into the first advance and retard chambers 208, 210 from lines 212, 213 and whether passage 242 is open between the first advance and first retard chambers 208, 210, allowing direct fluid communication between them. The word "directly" meaning allowing for fluid communication between the chambers without any intervening structures or valve to prevent bidirectional fluid flow. The switching valve 238 is housed in a bore in the rotor 201 and has a spool 240 with a plurality of cylindrical lands 240*a*, 240*b*, 240*c*, 240*d*, and 240*e*. The spool 240 is biased by spring 246. The first and second vanes 206*a*, 206*b* are capable of rotation to shift the relative angular position of the housing 200 and the rotor 201.

A phase control valve, preferably a spool valve 204 is includes of a spool 209 with cylindrical lands 209*a* and 209*b* slidably received in a bore in the rotor 201. The position of the spool 209 is influenced by spring 205 and a variable force solenoid (VFS) 203 controlled by the ECU 202.

To move towards the advance position, the force of the VFS 203 was increased and the spool 209 was moved to the right by the VFS 203, until the force of the spring 205 balances the force of the VFS 203. In the position shown, spool land 209*a* blocks line 212 and lines 213 and 216 are open. Camshaft torque pressurizes the second retard chamber 234, causing fluid in the second retard chamber 234 to move into the second advance chamber 232 and vane 206*b* to move in the direction indicated by arrow 261. Fluid exits from the second retard chamber 234 through line 230 to line 213, and the spool valve 204 between spool lands 209*a* and 209*b* and recirculates back to central line 216, line 212, and line 228 leading to the second advance chamber 232. As stated earlier, negative cam torsionals are used to move the vane 206*b* in the direction shown by arrow 261.

Fluid is prevented from entering the first advance chamber 208 or the first retard chamber 210 by the switching valve 238. The spool 240 of the switching valve 238 is biased to a first position, shown in FIG. 2*b*, in which the force of the spring 246 is greater then the pressure of fluid available from line 236, which is connected to line 218 and supply S. In this position, any fluid flow that flows through line 212 to the first advance chamber 208 is blocked by spool land 240*a* of the switching valve 238 and any fluid that flows through line 213 to the first retard chamber 210 is blocked by spool land 240*d* of the switching valve 238. Any fluid that is present in the first advance 208 and retard chambers 210 recirculates directly between the chambers through passage 242 and switching valve 238 between lands 240*b* and 240*c*, and 240*c* and 240*d*. The word "directly" meaning allowing for fluid communication between the chambers without any intervening structures or valve to prevent bidirectional fluid flow. Since fluid from the central line 216, the second advance chamber 232, and second retard chamber 234 cannot reach the first advance chamber 208 and the first retard chamber 210, the chambers 208, 210 are deactivated or switched out of use and the total active volume of the chambers of the phaser is limited to the active volume of the second advance chamber 232 and the active volume of the second retard chamber 234. The vane 206*a* separating the deactivated chambers 208, 210 is inactive. The vane 206*b* separating the active chambers 232, 234 is active Makeup oil is supplied to the phaser from supply to make up for leakage and enters line 218 and moves through inlet check valve 219 to the spool valve 204. From the spool valve 204 fluid enters line 216 through either of the check valves 214, 215, depending on which is open to either the second advance chamber 232 or the second retard chamber 234.

FIG. 10*b* shows the phaser moving towards the advance position with the switching valve in the second position. When the switching valve is in the second position, the total active volume of the phaser increases from two chambers to four chambers. The switching valve is moved from the first position to the second position when the pressure of fluid from the supply line 218 and in line 236 is greater than the force of spring 246, until the pressure of the fluid line 236 is equal to the force of spring 246. Spool lands 240*c* and 240*d* block passage 242 and open lines 212 and 213 to the first advance chamber 208 and the first retard chamber 210, respectively.

In moving towards the advance position, as shown in FIG. 2*d*, the force of the VFS 203 was increased and the spool 209 was moved to the right in the figure by the VFS 203, until the force of spring 205 balances the force of the VFS 203. In the position shown, spool land 209*a* blocks line 212, and lines 213 and 216 are open. Camshaft torque pressurizes the first retard chamber 210 and the second retard chamber 234, causing fluid in the first retard chamber 210 and the second retard chamber 234, to move into the first advance chamber 208 and the second advance chamber 232, respectively and vanes 206*a* and 206*b* to move in the direction indicated by arrows 261 and 271 respectively. Fluid exits from the first retard chamber 210 through line 213 and the switching valve 238 between spool lands 240*d* and 240*e* to the spool valve 204 between lands 209*a* and 209*b* and recirculates back to central line 216 and the first advance chamber 208. Fluid also exits from the second retard chamber 234 through line 230 to line 213 and the spool valve 204 between spool lands 209*a* and 209*b* and recirculates back to central line 216 and the second advance chamber 232. Fluid is prevented from directly circulating between the first advance chamber 208 and the first retard chamber 210 by blocking passage 242 with lands 240*c* and 240*d* of the switching valve 238. The word "directly" meaning allowing for fluid communication between the chambers without any intervening structures or valve to prevent bidirectional fluid flow.

Since fluid from the central line 216 and the second advance chamber 232 and second retard chamber 234 can reach the first advance chamber 208 and the first retard chamber 210, chambers 208, 210 are activated or switched into use and the total active volume of the chambers of the phaser includes all of the chambers 208, 210, 232, 234. The vanes 206*a*, 206*b* separating the activated chambers 208, 210 and 232, 234 that are active.

Makeup oil is supplied to the phaser from supply to make up for leakage and enters line 218 and moves through inlet check valve 219 to the spool valve 204. From the spool valve fluid enters line 216 through either of the check valves 214, 215, depending on which is open, to either the first advance chamber 208 and the second advance chamber 232, or the first retard chamber 210 and the second retard chamber 234.

Figure 11A:
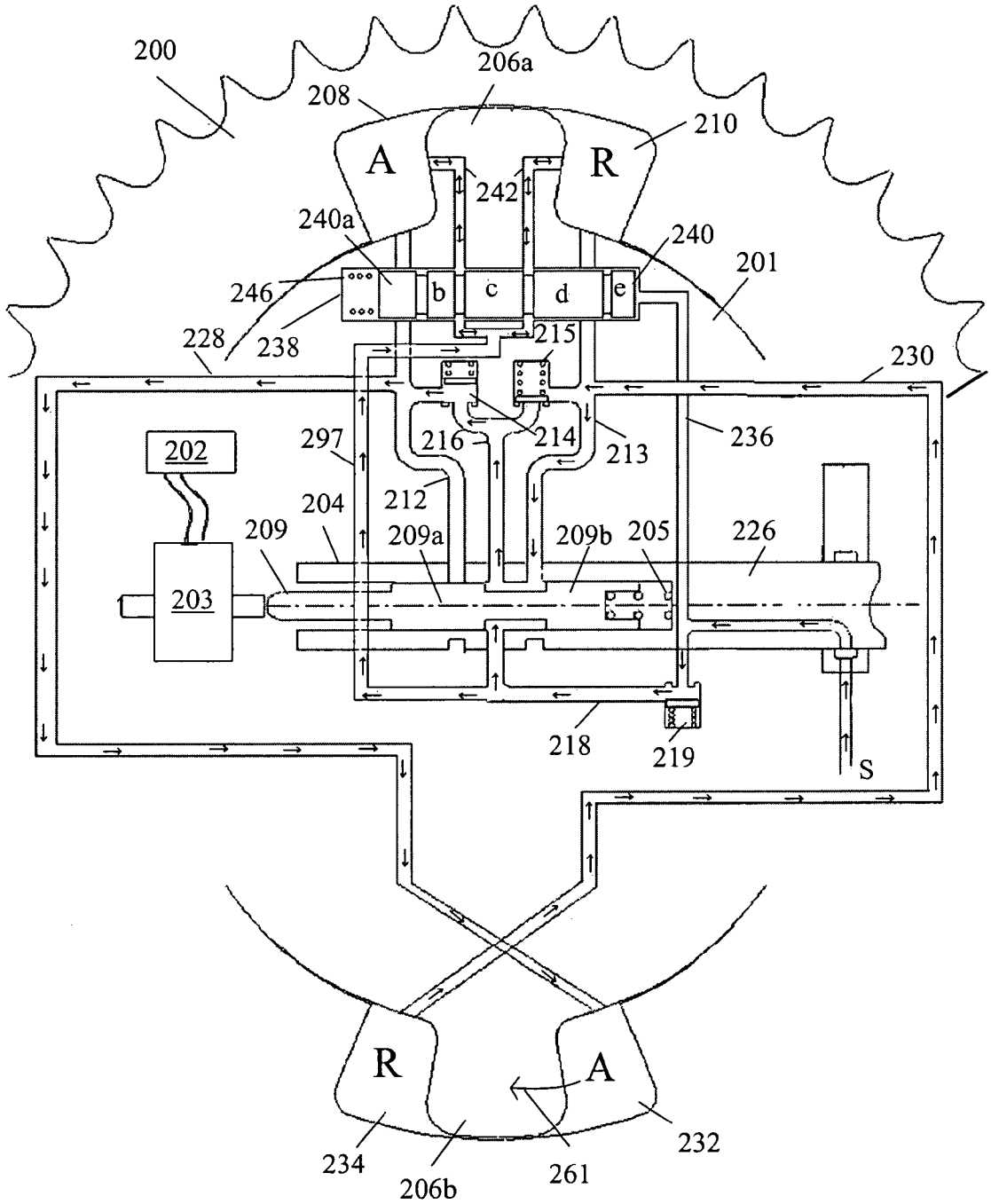
FIG. 11*a* shows a schematic of a cam torque actuated (CTA) phaser of a ninth embodiment, with the phaser shifting to the advance position and with a switching valve in a first position.
Figure 11B:
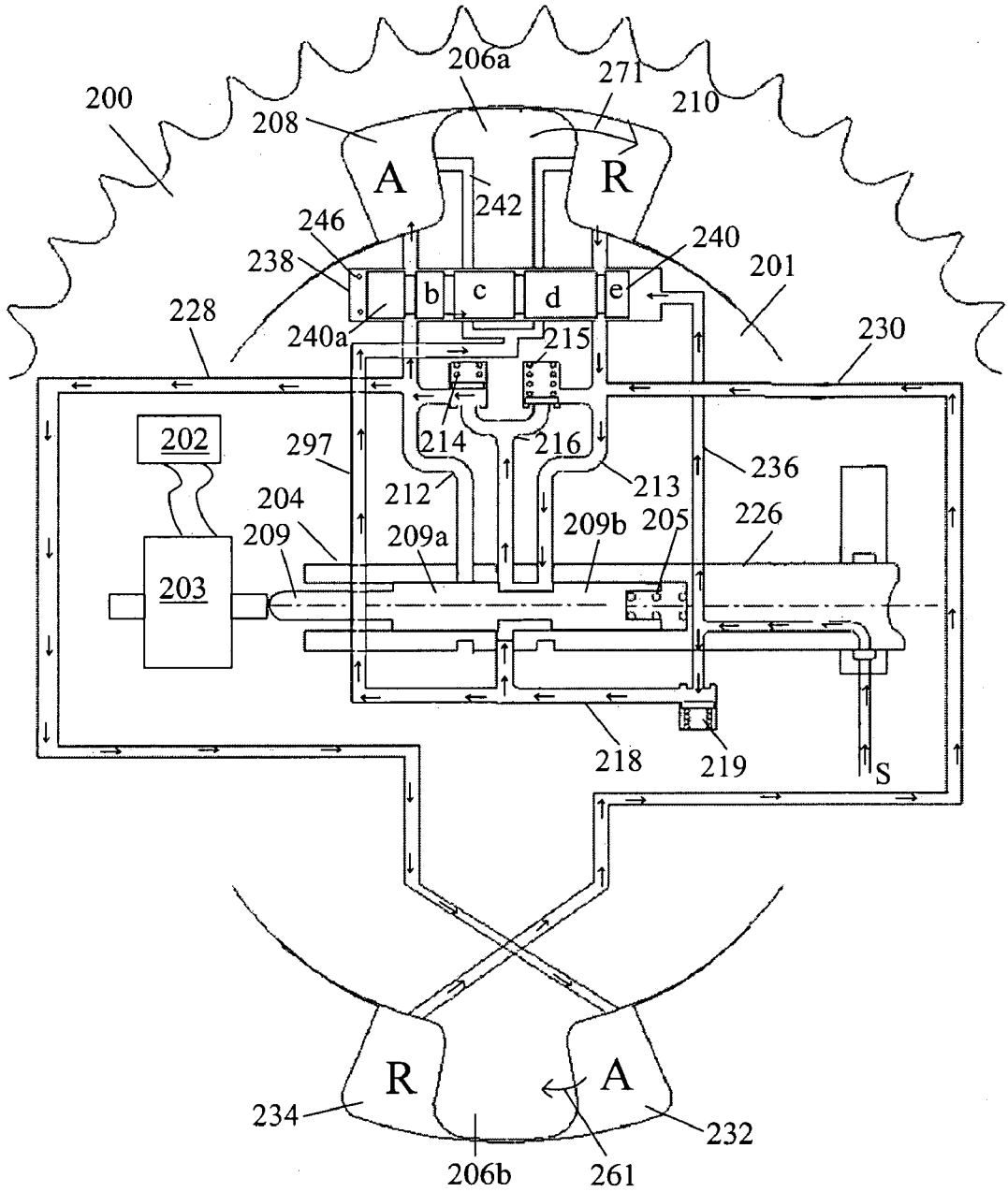
FIG. 11*b* shows a schematic of a cam torque actuated (CTA) phaser of a ninth embodiment, with the phaser shifting to the advance position and with a switching valve in a second position.

FIG. 11*a* shows an alternate embodiment of a cam torque actuated phaser in the advance position with the switching valve in the first position. FIG. 11*b* shows an alternative embodiment of a cam torque actuated phaser in the advance position with the switching valve in the second position. The phaser is similar to the phasers shown in FIGS. 2*a* through 2*d*, except for an additional supply line 297 that has been added between the supply line 218 after the inlet check valve 219 leading to a portion of passage 242 between the switching valve 240 and the phase control valve 204. As soon as switching valve lands 240*c* and 240*d* block passage 242 to the deactivated chambers 208, 210, fluid from line 298 is present to immediately fill or add additional fluid to the chambers 208, 210 to maintain the fluid level so that an immediate response is received. If additional fluid is not supplied to the deactivated chambers 206, 208, the chambers may eventually leak and become filled with air, causing a delay or loss of control of the phaser when the deactivated chambers become active again.

As described earlier, the housing 200 of the phaser has an outer circumference for accepting drive force. The rotor 201 is connected to the camshaft 226 and is coaxially located within the housing 200. The rotor 201 has a first vane 206*a*, and a second vane 206*b*, with the first vane 206*a* separating a first chamber formed between the housing 200 and the rotor 201 into the first advance chamber 208 and first retard chamber 210, and the second vane 206*b* separating a second chamber formed between the housing 200 and the rotor 201 into the second advance chamber 232 and the second retard chamber 234. The first advance chamber 208 is connected to the first retard chamber 210 by passage 242. A switching valve 238 controls whether fluid is allowed into the first advance and retard chambers 208, 210 from lines 212, 213 and whether passage 242 is open between the first advance and first retard chambers 208, 210, allowing direct fluid communication between them. The word "directly" meaning allowing for fluid communication between the chambers without any intervening structures or valve to prevent bidirectional fluid flow. The switching valve 238 is housed in a bore in the rotor 201 and has a spool 240 with a plurality of cylindrical lands 240*a*, 240*b*, 240*c*, 240*d*, and 240*e*. The spool 240 is biased by spring 246. The first and second vanes 206*a*, 206*b* are capable of rotation to shift the relative angular position of the housing 200 and the rotor 201.

A phase control valve, preferably a spool valve 204 is includes of a spool 209 with cylindrical lands 209*a* and 209*b* slidably received in a bore in the rotor 201. The position of the spool 209 is influenced by spring 205 and a variable force solenoid (VFS) 203 controlled by the ECU 202.

To move towards the advance position, the force of the VFS 203 was increased and the spool 209 was moved to the right by the VFS 203, until the force of the spring 205 balances the force of the VFS 203. In the position shown, spool land 209*a* blocks line 212 and lines 213 and 216 are open. Camshaft torque pressurizes the second retard chamber 234, causing fluid in the second retard chamber 234 to move into the second advance chamber 232 and vane 206*b* to move in the direction indicated by arrow 261. Fluid exits from the second retard chamber 234 through line 230 to line 213, and the spool valve 204 between spool lands 209*a* and 209*b* and recirculates back to central line 216, line 212, and line 228 leading to the second advance chamber 232. As stated earlier, negative cam torsionals are used to move the vane 206*b* in the direction shown by arrow 261.

Fluid is prevented from entering the first advance chamber 208 or the first retard chamber 210 by the switching valve 238. The spool 240 of the switching valve 238 is biased to a first position, shown in FIG. 2*b*, in which the force of the spring 246 is greater then the pressure of fluid available from line 236, which is connected to line 218 and supply S. In this position, any fluid flow that flows through line 212 to the first advance chamber 208 is blocked by spool land 240*a* of the switching valve 238 and any fluid that flows through line 213 to the first retard chamber 210 is blocked by spool land 240*d* of the switching valve 238. Any fluid that is present in the first advance 208 and retard chambers 210 recirculates directly between the chambers through passage 242 and switching valve 238 between lands 240*b* and 240*c*, and 240*c* and 240*d*. The word "directly" meaning allowing for fluid communication between the chambers without any intervening structures or valve to prevent bidirectional fluid flow. Since fluid from the central line 216, the second advance chamber 232, and second retard chamber 234 cannot reach the first advance chamber 208 and the first retard chamber 210, the chambers 208, 210 are deactivated or switched out of use and the total active volume of the chambers of the phaser is limited to the active volume of the second advance chamber 232 and the active volume of the second retard chamber 234. The vane 206*a* separating the deactivated chambers 208, 210 is inactive. The vane 206*b* separating the active chambers 232, 234 is active Makeup oil is supplied to the phaser from supply to make up for leakage and enters line 218 and moves through inlet check valve 219 to the spool valve 204. From the spool valve 204 fluid enters line 216 through either of the check valves 214, 215, depending on which is open to either the second advance chamber 232 or the second retard chamber 234.

FIG. 11*b* shows the phaser moving towards the advance position with the switching valve in the second position. When the switching valve is in the second position, the total active volume of the phaser increases from two chambers to four chambers. The switching valve is moved from the first position to the second position when the pressure of fluid from the supply line 218 and in line 236 is greater than the force of spring 246, until the pressure of the fluid line 236 is equal to the force of spring 246. Spool lands 240*c* and 240*d* block passage 242 and open lines 212 and 213 to the first advance chamber 208 and the first retard chamber 210, respectively.

In moving towards the advance position, as shown in FIG. 2*d*, the force of the VFS 203 was increased and the spool 209 was moved to the right in the figure by the VFS 203, until the force of spring 205 balances the force of the VFS 203. In the position shown, spool land 209*a* blocks line 212, and lines 213 and 216 are open. Camshaft torque pressurizes the first retard chamber 210 and the second retard chamber 234, causing fluid in the first retard chamber 210 and the second retard chamber 234, to move into the first advance chamber 208 and the second advance chamber 232, respectively and vanes 206*a* and 206*b* to move in the direction indicated by arrows 261 and 271 respectively. Fluid exits from the first retard chamber 210 through line 213 and the switching valve 238 between spool lands 240*d* and 240*e* to the spool valve 204 between lands 209*a* and 209*b* and recirculates back to central line 216 and the first advance chamber 208. Fluid also exits from the second retard chamber 234 through line 230 to line 213 and the spool valve 204 between spool lands 209*a* and 209*b* and recirculates back to central line 216 and the second advance chamber 232. Fluid is prevented from directly circulating between the first advance chamber 208 and the first retard chamber 210 by blocking passage 242 with lands 240*c* and 240*d* of the switching valve 238. The word "directly" meaning allowing for fluid communication between the chambers without any intervening structures or valve to prevent bidirectional fluid flow.

Since fluid from the central line 216 and the second advance chamber 232 and second retard chamber 234 can reach the first advance chamber 208 and the first retard chamber 210, chambers 208, 210 are activated or switched into use and the total active volume of the chambers of the phaser includes all of the chambers 208, 210, 232, 234. The vanes 206*a*, 206*b* separating the activated chambers 208, 210 and 232, 234 that are active.

Makeup oil is supplied to the phaser from supply to make up for leakage and enters line 218 and moves through inlet check valve 219 to the spool valve 204. From the spool valve fluid enters line 216 through either of the check valves 214, 215, depending on which is open, to either the first advance chamber 208 and the second advance chamber 232, or the first retard chamber 210 and the second retard chamber 234.

The word "directly" in the application is defined as allowing for fluid communication between the chambers without any intervening structures or valve to prevent bidirectional fluid flow.

The switching valve of any of the embodiments may have longer or shorter lands as shown in FIGS. 6*a* and 6*b*.

The switching valves of any of the above embodiments may be used with a cam torque actuated phaser, an oil pressure actuated phaser, or a torsion assist phaser.

The passages between the first advance and first retard chambers, the first advance and third advance chambers, or the first retard and the third retard chambers allow free fluid flow between the above chambers without any intervening valves or structures that would prevent bidirectional flow.

The vanes may also be connected in parallel.

In all of the above embodiments, a vane is active when it is acted upon by cam torque and/or oil pressure. A vane is inactive when a force is not acting on it.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine having at least one camshaft comprising:

a housing having an outer circumference for accepting drive force;

a rotor for connection to a camshaft coaxially located within the housing having a plurality of vanes defining at least two sets of chambers between the housing and the rotor, each set of chambers having an advance chamber and a retard chamber, wherein a first set of chambers is always in an active status, such that cam torque and/or oil pressure move the vane between the first set of chambers, and a second set of chambers is switched by a switching valve between the active status and an inactive status, such that cam torque and/or oil pressure do not act on the vane between the second set of chambers.

2. The phaser of claim 1, wherein the switching valve comprises a spool with a plurality of lands for blocking passage of fluid to and from the chambers and between the chambers.

3. A variable cam timing phaser for an internal combustion engine having at least one camshaft comprising:

a housing having an outer circumference for accepting drive force;

a rotor for connection to a camshaft coaxially located within the housing having a plurality of vanes, wherein the housing and the rotor define at least two chambers, a first chamber separated by a first vane into a first advance chamber and a first retard chamber, and a second chamber separated by a second vane into a second advance chamber and a second retard chamber, the first vane and the second vane being capable of rotation to shift relative angular position of the housing and the rotor;

a phase control valve for directing fluid flow to shift the relative angular position of the rotor relative to the housing;

a passage connecting the first advance chamber to the first retard chamber; and a switching valve having a first position in which fluid may flow freely between the passage connecting the first advance chamber to the first retard chamber, and fluid flow from the phase control valve to the first advance chamber and to the first retard chamber is blocked, and a second position in which the passage connecting the first advance chamber to the first retard chamber is blocked and fluid may flow freely between the phase control valve and the first advance chamber and the first retard chamber;

wherein when the switching valve is in the first position, the first advance chamber and the first retard chamber are switched out of use, by allowing fluid flow between the first advance chamber and the first retard chamber and fluid is blocked from entering the first retard chamber and the first advance chamber from the phase control valve.

4. The phaser of claim 3, further comprising a third chamber defined by the housing and the rotor and separated by a third vane into a third advance chamber and a third retard chamber.

5. The phaser of claim 4, wherein the third vane is connected in parallel with the first vane.

6. The phaser of claim 4, wherein when the switching valve is in the first position, the first advance chamber, the first retard chamber, the third advance chamber, and the third retard chamber are switched out of use, by allowing fluid flow between the first advance chamber and the first retard chamber through a passage, the first advance chamber and the third advance chamber through a second passage in parallel to the passage connecting the first advance chamber and the first retard chamber, and the first retard chamber and the third retard chamber through a third passage in parallel to passage connecting the first advance chamber to the first retard chamber, and fluid is blocked from entering the first advance chamber, the first retard chamber, the third advance chamber, and the third retard chamber from the phase control valve.

7. The phaser of claim 3, wherein the switching valve is a spool valve.

8. The phaser of claim 7, wherein the spool valve comprises a spool having a plurality of lands slidably received in a bore of the rotor.

9. The phaser of claim 3, wherein the switching valve is actuated by a variable force solenoid, an on/off solenoid, a pump, or a centrifugal valve.

10. The phaser of claim 3, wherein the switching valve is actuated by oil pressure.

11. The phaser of claim 10, wherein the oil pressure actuating the switching valve is dependent on engine oil pressure.

12. The phaser of claim 10, wherein the oil pressure actuating the switching valve is dependent on an ECU.

13. The phaser of claim 12, further comprising a regulator valve to increase the amount of pressure to the phaser.

14. The phaser of claim 3, wherein the phase control valve routes fluid from a pressurized fluid source to one of the advance chambers or one of the retard chambers and exhausts fluid from the other.

15. The phaser of claim 14, further comprising a check valve between the phase control valve and the pressurized fluid source.

16. The phaser of claim 3, wherein the phase control valve controls phaser position by selectively directing fluid from the advance chamber to the retard chamber and blocking reverse fluid flow.

17. The phaser of claim 16, further comprising a passage connected to a pressurized fluid source for supplying makeup fluid to the advance chamber and the retard chamber.

18. The phaser of claim 17, wherein the passage further comprises a check valve.

19. The phaser of claim 3, wherein the plurality of vanes are connected in parallel.

20. The phaser of claim 3, further comprising a supply line supplying fluid from a pressurized fluid source to a passage connecting the first advance chamber to the first retard chamber between the phase control valve and the switching valve.

21. A variable cam timing phaser for an internal combustion engine having at least one camshaft comprising:

a housing having an outer circumference for accepting drive force;

a rotor for connection to a camshaft coaxially located within the housing having at least three vanes, wherein the housing and the rotor define at least three chambers, a first chamber separated by a first vane into a first advance chamber and a first retard chamber, and a second chamber separated by a second vane into a second advance chamber and a second retard chamber, and a third chamber separated by a third vane into a third advance chamber and a third retard chamber, the first vane, the second vane, and the third vane being capable of rotation to shift relative angular position of the housing and the rotor;

a phase control valve for directing fluid flow to shift the relative angular position of the rotor relative to the housing;

a switching valve having a first position in which fluid may flow freely, without any intervening structures to prevent bidirectional flow, between a first passage connecting the first advance chamber to the first retard chamber, a second passage connecting the first advance chamber to the third advance chamber, and a third passage connecting the first retard chamber to the third retard chamber, and fluid flow from the phase control valve to the first advance chamber, and to the first retard chamber is blocked, and fluid may flow freely between the phase control valve and the first advance chamber, the first retard chamber, the third advance chamber, and the third retard chamber;

wherein when the switching valve is in the first position, the first advance chamber and the first retard chambers are switched out of use, by allowing fluid flow between the first advance chamber and the third advance chamber, the first advance chamber the first retard chamber, and the first retard chamber and the third retard chamber and fluid is blocked from entering the first retard chamber and the first advance chamber from the phase control valve.

22. The phaser of claim 21, wherein the phase control valve is a spool valve comprising a spool having a plurality of lands slidably received in a bore of the rotor.

23. The phaser of claim 21, wherein the switching valve is a spool valve.

24. The phaser of claim 21, wherein the switching valve is actuated by a variable force solenoid, an on/off solenoid, a pump, or a centrifugal valve.

25. The phaser of claim 21, wherein the switching valve is actuated by oil pressure.

26. The phaser of claim 25, wherein the oil pressure actuating the switching valve is dependent on engine oil pressure.

27. The phaser of claim 25, wherein the oil pressure actuating the switching valve is dependent on an ECU.

28. The phaser of claim 27, further comprising a regulator valve to increase the amount of pressure to the phaser.

29. The phaser of claim 21, wherein the phase control valve routes fluid from a pressurized fluid source to one of the advance chambers or one of the retard chambers and exhausts fluid from the other.

30. The phaser of claim 29, further comprising a check valve between the phase control valve and the pressurized fluid source.

31. The phaser of claim 21, wherein the phase control valve controls phaser position by selectively directing fluid from the advance chamber to the retard chamber and blocking reverse fluid flow.

32. The phaser of claim 31, further comprising a passage connected to a pressurized fluid source for supplying makeup fluid to the advance chamber and the retard chamber.

33. The phaser of claim 32, wherein the passage further comprises a check valve.

34. The phaser of claim 21, wherein the third vane is connected in parallel to the first vane.

35. A variable cam timing phaser for an internal combustion engine having at least one camshaft comprising:

a housing having an outer circumference for accepting drive force;

a rotor for connection to a camshaft coaxially located within the housing having at least three vanes, wherein the housing and the rotor define at least three chambers, a first chamber separated by a first vane into a first advance chamber and a first retard chamber, and a second chamber separated by a second vane into a second advance chamber and a second retard chamber, and a third chamber separated by a third vane into a third advance chamber and a third retard chamber having an exhaust line attached to the third advance chamber, the first vane, the second vane, and the third vane, being capable of rotation to shift relative angular position of the housing and the rotor;

a phase control valve for directing fluid flow to shift the relative angular position of the rotor relative to the housing;

a first passage connecting the first advance chamber to the first retard chamber; and a first switching valve having a first position in which fluid may flow freely between the first passage connecting the first advance chamber to the first retard chamber, and fluid flow from the phase control valve to the first advance chamber, and to the first retard chamber is blocked, and a second position in which the first passage connecting the first advance chamber to the first retard chamber is blocked and fluid may flow freely between the phase control valve to the first advance chamber and the first retard chamber;

a second passage connecting the third advance chamber to the third retard chamber;

a second switching valve having a first position in which fluid may flow freely between the second passage connecting the third advance chamber to the third retard chamber, and fluid flow from the phase control valve to the third advance chamber is blocked, and a second position in which the second passage connecting the third advance chamber to the third retard chamber is blocked and fluid may flow freely between the phase control valve to the third advance chamber is permitted;

wherein when the first switching valve is in the first position, the first advance chamber and the first retard chambers are switched out of use, by allowing fluid flow between the first advance chamber and the first retard chamber and fluid is blocked from entering the first retard chamber and the first advance chamber from the phase control valve;

wherein when the second switching valve is in the first position, the third advance chamber and the third retard chamber are switched out of use, by allowing fluid flow between the third advance chamber and the third retard chamber, and fluid is blocked from entering the third advance chamber from the phase control valve.

36. The phaser of claim 35 wherein the first switching valve and the second switching valve are spool valves.

37. The phaser of claim 36 wherein the spool valves comprise a spool having a plurality of lands slidably received in a bore of the rotor.

38. The phaser of claim 35 wherein the first switching valve and the second switching valve are actuated by a variable force solenoid, an on/off solenoid, a pump, or a centrifugal valve.

39. The phaser of claim 35, wherein the switching valve is actuated by oil pressure.

40. The phaser of claim 39, wherein the oil pressure actuating the switching valve is dependent on engine oil pressure.

41. The phaser of claim 39, wherein the oil pressure actuating the switching valve is dependent on an ECU.

42. The phaser of claim 41, further comprising a regulator valve to increase the amount of pressure to the phaser.

43. The phaser of claim 35, wherein the second passage is connected in parallel with the first passage.

44. The phaser of claim 35 wherein the phase control valve controls phaser position by selectively directing fluid from the advance chamber to the retard chamber and blocking reverse fluid flow.

45. The phaser of claim 44, further comprising a passage connected to a pressurized fluid source for supplying makeup fluid to the advance chamber and the retard chamber.

* * * * *